US008712260B2

(12) United States Patent
Suzuki

(10) Patent No.: US 8,712,260 B2
(45) Date of Patent: Apr. 29, 2014

(54) PRINTING APPARATUS

(75) Inventor: Noritaka Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 484 days.

(21) Appl. No.: 12/731,212

(22) Filed: Mar. 25, 2010

(65) Prior Publication Data

US 2010/0247193 A1 Sep. 30, 2010

(30) Foreign Application Priority Data

Mar. 30, 2009 (JP) ..... 2009-081384

(51) Int. Cl.

| | |
|---|---|
| ***G03G 15/00*** | (2006.01) |
| ***G03G 21/00*** | (2006.01) |
| ***B41J 3/60*** | (2006.01) |
| ***B65H 85/00*** | (2006.01) |

(52) U.S. Cl.
USPC ..... 399/19; 399/9; 347/104

(58) Field of Classification Search
CPC ..... G03G 15/00; G03G 21/00; B41J 3/60; B65H 85/00
USPC ..... 399/19
See application file for complete search history.

(56) References Cited

U.S. PATENT DOCUMENTS

| | | | | |
|---|---|---|---|---|
| 6,330,425 | B1 * | 12/2001 | Ohuchi et al. | 399/401 |
| 7,379,678 | B2 * | 5/2008 | Motoyama et al. | 399/16 |
| 2006/0269300 | A1 * | 11/2006 | Motoyama et al. | 399/16 |

FOREIGN PATENT DOCUMENTS

| | | | | |
|---|---|---|---|---|
| JP | 09-249342 | | 9/1997 | |
| JP | 10157212 | A * | 6/1998 | B41J 29/46 |
| JP | 11288197 | A * | 10/1999 | G03G 15/00 |
| JP | 2001063152 | A * | 3/2001 | G03G 21/00 |
| JP | 2001305918 | A * | 11/2001 | G03G 21/00 |
| JP | 2003175656 | A * | 6/2003 | B41J 29/38 |
| JP | 2005125678 | A * | 5/2005 | G03G 15/00 |
| JP | 2007168103 | A * | 7/2007 | G03G 21/00 |

* cited by examiner

*Primary Examiner* — Nguyen Ha
(74) *Attorney, Agent, or Firm* — Kubotera & Associates, LLC

(57) ABSTRACT

A printing apparatus for performing a printing operation includes an image forming portion for forming an image on a surface of a sheet according to image data; a discharge portion for discharging the sheet with the image formed thereon with the image forming portion; a reverse transportation unit for returning the sheet discharged with the discharge portion into the printing apparatus to reverse the sheet, so that another image is formed on another surface of the sheet according to image data; a detection unit for detecting the sheet discharged with the discharge portion when the sheet is pulled out before the reverse transportation unit returns the sheet; and a control unit for controlling the image forming portion to form the image on another sheet according to the image data when the detection unit detects that the sheet is pulled out.

14 Claims, 13 Drawing Sheets

PRINTING APPARATUS

BACKGROUND OF THE INVENTION AND RELATED ART STATEMENT

The present invention relates to a printing apparatus. More specifically, the present invention relates to a printing apparatus having a duplex printing mechanism capable of forming a toner image on both sides of a sheet using a switchback method in which a rotational direction of a discharge roller is switched.

When a conventional printing apparatus performs a duplex printing operation, after an image forming process and an image fixing process are performed on one side (a first surface) of a sheet, a discharge roller rotates in a forward direction to transport the sheet toward a discharge outlet. Then, the discharge roller stops, so that a part of the sheet (a leading edge) is discharged from the discharge outlet.

Afterward, the discharge roller rotates in a reverse direction, i.e., performs a switchback, so that the sheet is pulled back in the conventional printing apparatus. Accordingly, the sheet is transported into a reverse path, so that a second surface of the sheet faces upwardly. After the sheet is reversed in the reverse path, the image forming process and the image fixing process are performed on a second surface of the sheet followed by discharging the sheet through the discharge outlet.

In the conventional printing apparatus, in a state that a part of the sheet is discharged from the discharge outlet, an operator may think that the printing operation is completed, and pull out the sheet. In the conventional printing apparatus, when the operator pulls out the sheet, a sensor disposed at an inlet of the reverse path detects that the sheet does not reach the reverse path. Accordingly, the conventional printing apparatus falsely determines that a jam (a paper jam) occurs, and stops the printing operation. As a result, the conventional printing apparatus displays notice information on a display thereof for prompting the operation to remove the jam from the conventional printing apparatus.

When the notice information is displayed on the display, the operator opens a cover of the conventional printing apparatus, and closes the cover after the operator confirms that there is no jam. In the conventional printing apparatus, various sensors disposed in the conventional printing apparatus detect the opening and closing of the cover. After the various sensors detect that there is no jam in the conventional printing apparatus, the printing operation is resumed.

As described above, in the conventional printing apparatus, once the operator mistakenly pulls out the sheet, the conventional printing apparatus detects the pullout as the jam and stops the printing operation. Accordingly, in order to resume the printing operation, it is necessary to perform the operation including the opening and closing of the cover similar to a case that the jam actually occurs, thereby causing a trouble to the operator.

To this end, Patent Reference has proposed another conventional image forming apparatus. In the conventional image forming apparatus disclosed in Patent Reference, a stepping motor drives a discharge roller. When the discharge roller stops, a current flowing in the stopping motor is maintained for applying a load to the discharge roller. Accordingly, when the duplex printing operation is performed, it is possible to prevent a sheet from being pulled out during the switchback.

Patent Reference: Japanese Patent Publication No. 09-249342

As explained above, the conventional image forming apparatus disclosed in Patent Reference has the configuration for preventing the sheet from being pulled out. When the conventional image forming apparatus performs the duplex printing operation, however, a part of the sheet is still discharged from a discharge outlet. Accordingly, an operator still can pull out the sheet. When the operator pulls out the sheet, the conventional image forming apparatus stops the duplex printing operation, thereby making it necessary to resume the duplex printing operation.

In view of the problems described above, an object of the present invention is to provide a printing apparatus capable of solving the problems. In the present invention, when the printing apparatus performs the duplex printing operation, it is possible to continue the duplex printing operation without interrupting the duplex printing operation even when a sheet is pulled out after the printing operation is performed on one side of the sheet.

Further objects and advantages of the invention will be apparent from the following description of the invention.

SUMMARY OF THE INVENTION

In order to attain the objects described above, according to a first aspect of the present invention, a printing apparatus for performing a printing operation includes an image forming portion for forming a first image on a first surface of a first sheet transported from a sheet supply portion according to first image data; a discharge portion for discharging the first sheet with the first image formed thereon with the image forming portion; a reverse transportation unit for returning the first sheet discharged with the discharge portion into the printing apparatus to reverse the first sheet, so that a second image is formed on a second surface of the first sheet according to second image data; a detection unit for detecting the first sheet discharged with the discharge portion when the first sheet is pulled out before the reverse transportation unit returns the first sheet; and a control unit for controlling the image forming portion to form the second image on a second sheet according to the second image data when the detection unit detects that the first sheet is pulled out.

In the present invention, after the image forming portion forms the first image on the first surface of the first sheet, when the first sheet is pulled out from the discharge portion, the detection unit detects that the first sheet is pulled out. Then, the control unit controls the image forming portion to form the second image on the second sheet. Accordingly, it is possible to continue the printing operation even after the first sheet is pulled out from the discharge portion. As a result, it is not necessary to stop the duplex printing operation and an operation necessary for removing a jam when the pull out of the sheet is determined as the jam, thereby improving operability of the printing apparatus.

DETAILED DESCRIPTION OF THE PREFERRED EMBODIMENTS

Hereunder, embodiments of the present invention will be explained with reference to the accompanying drawings. In the following description, a printer will be explained as a printing apparatus, and a host device includes a user terminal such as a PC (Personal Computer) and the like.

First Embodiment

Figure 2:
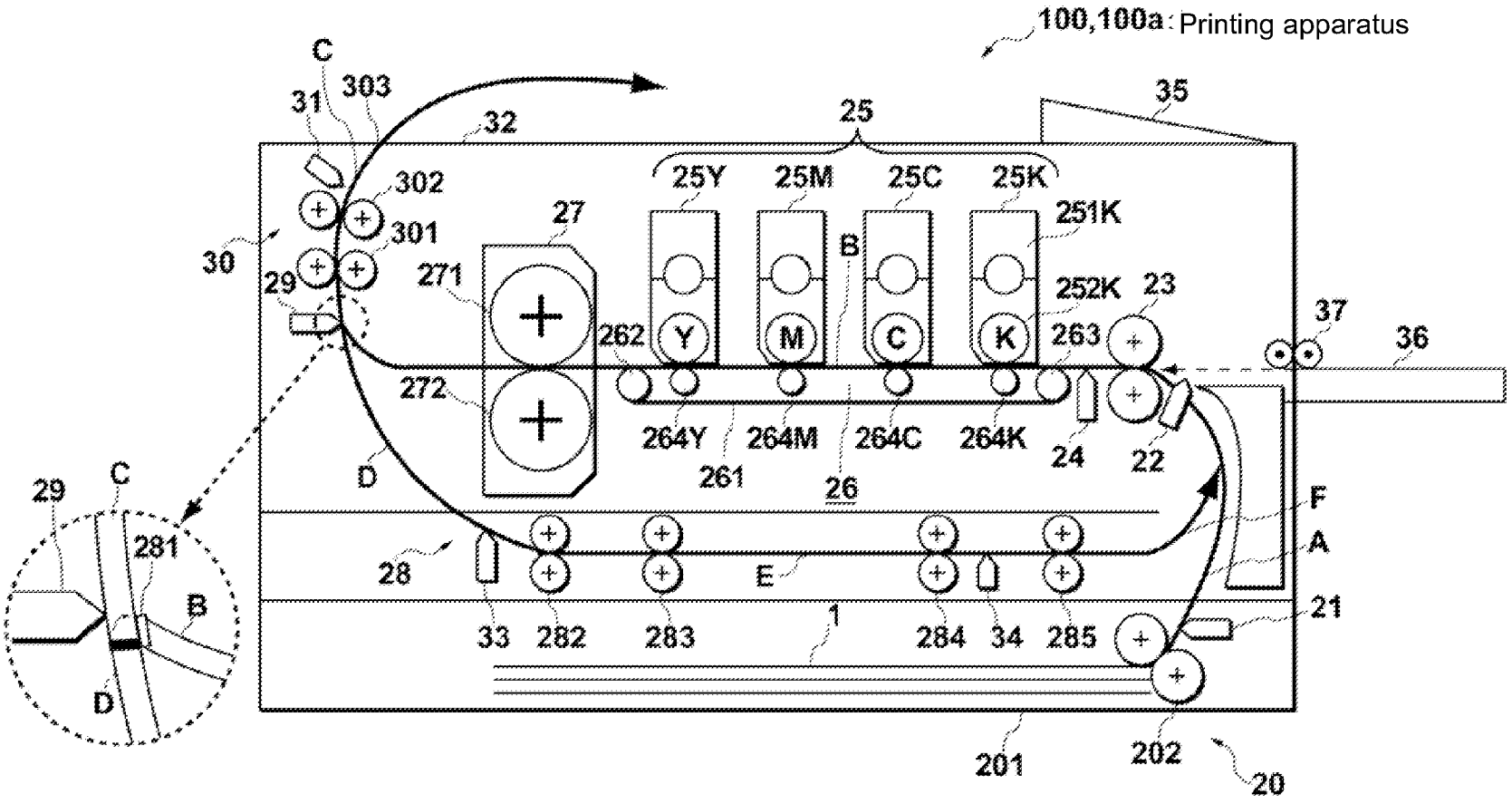
FIG. 2 is a schematic sectional view showing the printing apparatus according to the first embodiment and a second embodiment of the present invention.

A first embodiment of the present invention will be explained. FIG. 2 is a schematic sectional view showing a printing apparatus 100 according to the first embodiment of the present invention.

As shown in FIG. 2, the printing apparatus 100 includes a sheet supply cassette 201 at a lower portion thereof for retaining a sheet 1 in a stacked state. The sheet supply cassette 201 constitutes a part of a sheet supply unit 20, and is detachably attached to the printing apparatus 100.

In the embodiment, the printing apparatus 100 includes one sheet supply cassette, i.e., the sheet supply cassette 201, and may include a plurality of sheet supply cassettes. Further, in the printing apparatus 100, the sheet 1 is supplied from the sheet supply cassette 201. Alternatively, the printing apparatus 100 may include a manual tray 36 disposed at a side portion thereof. In this case, the sheet 1 is inserted into the manual tray 36, so that a manual sheet supply roller 37 transports the sheet 1.

In the embodiment, a sheet supply roller pair 202 is disposed on a pick-up side of the sheet supply cassette 201 for picking up the sheet 1 retained in the sheet supply cassette 201 one by one. The sheet supply roller pair 202 constitutes a part of the sheet supply unit 20, and is arranged to contact with the sheet 1 at an uppermost position in the sheet supply cassette 201. When a drive unit (not shown) drives the sheet supply roller pair 202 to rotate according to a control of a print control unit 110 (refer to FIG. 1), the sheet supply roller pair 202 picks up the sheet 1 from the sheet supply cassette 201. After the sheet supply roller pair 202 picks up the sheet 1, the sheet 1 is transported to a transportation path A.

In the embodiment, a sheet supply sensor 21 is disposed in front of the sheet supply roller pair 202 for detecting the sheet 1 when the sheet supply roller pair 202 transports the sheet 1 from the sheet supply cassette 201. When the sheet supply sensor 21 detects a leading edge of the sheet 1, the sheet supply sensor 21 starts sending a sheet supply detection signal (sheet supply sensor ON) to the print control unit 110 through a control unit 101 (refer to FIG. 1). When a trailing edge of the sheet 1 passes through the sheet supply sensor 21, the sheet supply sensor 21 stops sending the sheet supply detection signal (sheet supply sensor OFF).

In the embodiment, an inlet sensor 22 is disposed in front of a register roller pair 23 for detecting a timing when the print control unit 110 controls the drive unit to rotate the register roller pair 23. When the inlet sensor 22 detects the leading edge of the sheet 1, the inlet sensor 22 starts sending an inlet detection signal (inlet sensor ON) to the print control unit 110 through the control unit 101. When the trailing edge of the sheet 1 passes through the inlet sensor 22, the inlet sensor 22 stops sending the inlet detection signal (inlet sensor OFF).

In the embodiment, after the print control unit 110 receives the sheet supply detection signal when the print control unit 110 receives the inlet detection signal, the print control unit 110 controls the drive unit to rotate the register roller pair 23. Accordingly, the register roller pair 23 rotates to transport the sheet 1 toward a writing sensor 24 disposed at a rear side along a transportation path B.

As shown in FIG. 2, the printing apparatus 100 includes an image forming portion 25 having image forming units 25K to 25Y. Each of the image forming units 25K to 25Y includes a photosensitive drum for forming a developer image thereon in each color. The writing sensor 24 is provided for matching a starting position of the developer image on the photosensitive drum to a starting position of the developer image to be printed on the sheet 1. When the writing sensor 24 detects the leading edge of the sheet 1, the writing sensor 24 starts sending a writing detection signal (writing sensor ON) to the print control unit 110 through the control unit 101. When the trailing edge of the sheet 1 passes through the writing sensor 24, the writing sensor 24 stops sending the writing detection signal (writing sensor OFF).

In the embodiment, the image forming unit 25K forms the developer image in black (K). As shown in FIG. 2, the image forming unit 25K includes a toner storage portion 251K for retaining toner in black as developer. The image forming unit 25K forms the developer image on a photosensitive drum 252K using toner in black supplied from the toner storage portion 251K.

Similarly, the image forming unit 25C forms the developer image in cyan (C). As shown in FIG. 2, the image forming unit 25C includes a toner storage portion for retaining toner in cyan as developer. The image forming unit 25C forms the developer image on a photosensitive drum using toner in cyan supplied from the toner storage portion.

Similarly, the image forming unit 25M forms the developer image in magenta (M). As shown in FIG. 2, the image forming unit 25M includes a toner storage portion for retaining toner as in magenta developer. The image forming unit 25M forms the developer image on a photosensitive drum using toner in magenta supplied from the toner storage portion.

Similarly, the image forming unit 25Y forms the developer image in yellow (Y). As shown in FIG. 2, the image forming unit 25Y includes a toner storage portion for retaining toner in yellow as developer. The image forming unit 25Y forms the developer image on a photosensitive drum using toner in yellow supplied from the toner storage portion.

In the embodiment, when the print control unit 110 receives the writing signal, the print control unit 110 controls an exposure device (not shown) of the image forming unit 25K to expose the photosensitive drum 252K. The exposure device is formed of, for example, LEDs (Light Emitting Diodes) arranged therein. The LEDs emit light according to the control of the print control unit 110, so that a static latent image is formed on a surface of the photosensitive drum 252K according to image data stored in an image memory 103 (refer to FIG. 1).

In the embodiment, when the static latent image is formed on the surface of the photosensitive drum 252K, the print control unit 110 controls a supply roller (not shown) to attach toner in black supplied from the toner storage portion 251K to a surface of a developer roller (not shown). Afterward, a layer forming blade (not shown) forms a toner layer with a uniform thickness, so that the static latent image on the photosensitive drum 252K is developed. Accordingly, the developer image in black corresponding to the static latent image is formed on the surface of the photosensitive drum 252K.

Similarly, the image forming units 25C, 25M, and 25Y form the developer images in cyan, magenta, and yellow on the photosensitive drums thereof through the image forming process described above.

In the embodiment, an image transfer portion 26 is arranged at a position to face the photosensitive drums of the image forming units 25K to 25Y. The image transfer portion 26 is provided for transferring the developer images in colors formed on the photosensitive drums of the image forming units 25K to 25Y to the sheet 1.

As shown in FIG. 2, the image transfer portion 26 includes a transfer belt 261, a belt drive roller 262, a follower roller 263, and transfer rollers 264K, 264C, 264M, and 264Y disposed to face the photosensitive drums through the transfer belt 261. The transfer belt 261 is wound around the belt drive roller 262 and the follower roller 263. The belt drive roller 262 drives the transfer belt 261 to move, so that the transfer belt 261 transports the sheet 1. Note that the transfer belt 261 constitutes a part of the transportation path B.

In the embodiment, the print control unit 110 controls and drives the image forming portion 25 and the image transfer portion 26 in synchronization. After the sheet 1 is statically attached to the transfer belt 261, the transfer belt 261 moves and transports the sheet 1. Then, the sheet 1 is transported between the photosensitive drum 252K and the transfer roller 264K. At this moment, a transfer voltage is applied to the transfer roller 264K under the control of the print control unit 110. Accordingly, the developer image in black formed on the surface of the photosensitive drum 252K is transferred to a first surface of the sheet 1.

After the developer image in black is transferred to the sheet 1, the sheet 1 is sequentially transported between the photosensitive drums of the image forming units 25C to 25Y and the transfer rollers 264C to 264Y. Accordingly, the developer images in cyan, magenta, and yellow are sequentially transferred to the first surface of the sheet 1. After the developer images in all colors are transferred to the sheet 1, the transfer belt 261 moves to transport the sheet 1 to an image fixing portion 27.

Note that when toner remains on the surfaces of the photosensitive drums of the image forming units 25K to 25Y, a cleaning blade (not shown) scrapes off and removes toner, so that toner is collected in a waste toner storage portion (not shown).

In the embodiment, the image fixing portion 27 is provided for fixing the developer images transferred on the sheet 1 to the sheet 1. The image fixing portion 27 is formed of a heating roller 271 and a pressing roller 272 disposed to abut against the heating roller 271. The heating roller 271 includes a heater (not shown) for heating the heating roller 271.

In the embodiment, after the developer images in all colors are transferred to the sheet 1, the heating roller 271 and the pressing roller 272 sandwich the sheet 1, so that the sheet 1 is transported while being heated and pressed, thereby fixing the developer images in all colors thus transferred. Afterward, the sheet 1 is transported to a reverse path switching lever 281 disposed at the rear side along the transportation path B. Note that the image forming portion 25, the image transfer portion 26, and the image fixing portion 27 constitute an image forming portion for performing a printing operation on the sheet 1.

In the embodiment, a reverse portion 28 includes the reverse path switching lever 281. The reverse path switching lever 281 is provided for transporting the sheet 1 to a reverse path D after discharge roller pairs 301 and 302 rotate in a reverse direction to pull back the sheet 1 in switchback after the printing operation is performed on the first surface of the sheet 1 in a duplex printing operation (described later).

In the embodiment, the print control unit 110 controls the reverse path switching lever 281 to rotate in an upward direction. After a specific period of time, the reverse path switching lever 281 rotates in a downward direction and returns to a regular position. When the reverse path switching lever 281 is situated at the regular position, the sheet 1 transported from the transportation path B is transported toward an upper portion of the printing apparatus 100 (a transportation path C) where a discharge portion 30 is disposed.

As shown in FIG. 2, the discharge portion 30 includes the discharge roller pairs 301 and 302 and a discharge outlet 303, and is provided for discharging the sheet 1 to a discharge stacker 32 disposed outside the printing apparatus 100 after the printing operation is completed. In other words, the discharge portion 30 is provided for discharging the sheet 1 outside the printing apparatus 100 (the discharge stacker 32).

In the embodiment, a discharge sensor 29 is disposed at an inlet of the transportation path C. The discharge sensor 29 is provided for detecting a timing when the print control unit 110 controls the drive unit to rotate and stop the discharge roller pairs 301 and 302 in a forward direction and a reverse direction.

In the embodiment, when the discharge sensor 29 detects the leading edge of the sheet 1, the discharge sensor 29 starts sending a discharge detection signal (discharge sensor ON) to the print control unit 110 through the control unit 101. When the trailing edge of the sheet 1 passes through the discharge sensor 29, the discharge sensor 29 stops sending the discharge detection signal (discharge sensor OFF).

In the embodiment, when the print control unit 110 receives the discharge detection signal, the print control unit 110 controls the drive unit to rotate the discharge roller pairs 301 and 302 in the forward direction. Accordingly, the discharge roller pairs 301 and 302 rotate to transport the sheet 1 toward a pullout sensor 31 disposed at a downstream side in a medium transportation direction along the transportation path C.

In the embodiment, in the duplex printing operation, after the printing operation is performed on the first surface of the sheet 1, when the print control unit 110 receives the discharge detection signal, the print control unit 110 obtains a medium feed time set in advance in a setting information storage unit 106 (refer to FIG. 1) through the control unit 101. Afterward, the print control unit 110 sets the medium feed time thus obtained as a counter value of a counter portion 1101 of the print control unit 110, so that the counter portion 1101 starts counting down the counter value.

In the embodiment, the pullout sensor 31 is disposed at a position near the discharge outlet 303. The pullout sensor 31 is provided for detecting the sheet 1 discharged from or pulled back into the discharge outlet 303. When the pullout sensor 31 detects the leading edge of the sheet 1, the pullout sensor 31 starts sending a discharge outlet proximity detection signal (pullout sensor ON) to the print control unit 110 through the control unit 101. When the trailing edge of the sheet 1 passes through the pullout sensor 31, the pullout sensor 31 stops sending the discharge outlet proximity detection signal (pullout sensor OFF).

In the embodiment, when the print control unit 110 receives the discharge outlet proximity detection signal, and the counter value becomes zero, the print control unit 110 controls the drive unit to stop the discharge roller pairs 301 and 302. At this moment, the sheet 1 stops in a state that a part of the sheet 1 (the leading edge) is discharged from the discharge outlet 303 while the discharge roller pairs 301 and 302 sandwich the sheet 1. Further, at this moment, the pullout sensor 31 detects the sheet 1 thus stopping. Accordingly, the pullout sensor 31 continues to send the discharge outlet proximity detection signal (pullout sensor ON). Further, at this moment, the trailing edge of the sheet 1 passes through the discharge sensor 29, so that the discharge sensor 29 stops sending the discharge detection signal (discharge sensor OFF).

Figure 3:
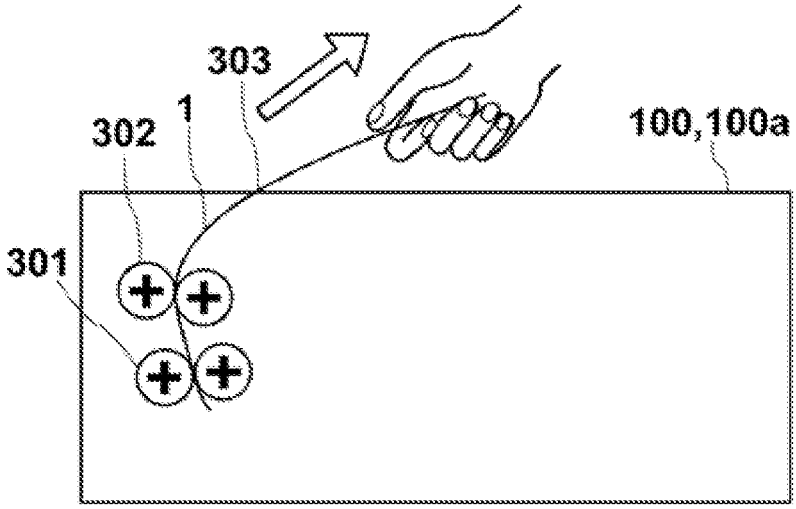
FIG. 3 is a schematic view showing an example of a case that a sheet is pulled out from the printing apparatus according to the first embodiment and the second embodiment of the present invention.

FIG. 3 is a schematic view showing an example of a case that the sheet 1 is pulled out from the printing apparatus 100 according to the first embodiment of the present invention.

As shown in FIG. 3, a part of the sheet 1 (the leading edge) is discharged from the discharge outlet 303 while the discharge roller pairs 301 and 302 sandwich the sheet 1. In this state, an operator may mistakenly recognize that the duplex printing operation is completed, and try to pull out the sheet 1 from the discharge outlet 303. If the sheet 1 is pulled out from the discharge outlet 303, the pullout sensor 31 stops sending the discharge outlet proximity detection signal (pullout sensor OFF). An operation of the printing apparatus 100 when the sheet 1 is pulled out will be explained later along with an explanation of a control system of the printing apparatus 100.

In the embodiment, after the print control unit 110 stops the discharge roller pairs 301 and 302, the print control unit 110 controls the drive unit to rotate the discharge roller pairs 301 and 302 in the reverse direction after a specific period of time set in advance, for example, less than one second, during which the trailing edge of the sheet 1 passes through the discharge roller pair 302. Accordingly, the sheet 1 sandwiched with the discharge roller pairs 301 and 302 is transported toward the discharge sensor 29 once again.

In the embodiment, when the discharge sensor 29 detects the leading edge of the sheet 1 (the trailing edge before the switchback), the discharge sensor 29 starts sending the discharge detection signal (discharge sensor ON) to the print control unit 110 through the control unit 101. When the print control unit 110 receives the discharge detection signal, the print control unit 110 controls the drive unit to rotate the reverse path switching lever 281 upwardly from the regular position while the discharge roller pairs 301 and 302 are rotating in the reverse direction.

In the embodiment, the reverse portion 28 is provided for reversing the sheet 1 such that a backside surface of the sheet 1 as a second surface faces upwardly after the printing operation is performed on the front surface or the first surface of the sheet 1 in the duplex printing operation. The reverse portion 28 includes reverse transportation roller pairs 282, 283, 284, and 285 and the reverse path switching lever 281. With the reverse path switching lever 281 and the reverse transportation roller pairs 282, 283, 284, and 285, in addition to the discharge roller pairs 301 and 302 of the discharge portion 30, it is possible to reverse and transport the sheet 1 to the register roller pair 23. A reverse transportation unit of the printing apparatus 100 includes the reverse portion 28, the discharge roller pairs 301 and 302, the reverse path D, a reverse path E, and a reverse path F. The reverse transportation unit is provided for pulling back and reversing the sheet 1 into the printing apparatus 100 after the discharge portion 30 discharges a part of the sheet 1 outside the printing apparatus 100.

In the embodiment, when the reverse path switching lever 281 rotates upwardly from the regular position, the sheet 1 pulled inside the printing apparatus 100 along the transportation path C is transported toward the reverse path D.

In the embodiment, a reverse inlet sensor 33 is provided in front of the reverse path D for detecting the sheet 1 transported from the reverse path D toward the reverse path E. When the reverse inlet sensor 33 detects the leading edge of the sheet 1, the reverse inlet sensor 33 starts sending a reverse inlet detection signal (reverse inlet sensor ON) to the print control unit 110 through the control unit 101. When the trailing edge of the sheet 1 passes through the reverse inlet sensor 33, the reverse inlet sensor 33 stops sending the reverse inlet detection signal (reverse inlet sensor OFF).

In the embodiment, when the print control unit 110 receives the reverse inlet detection signal, the print control unit 110 controls the drive unit to rotate the reverse transportation roller pairs 282, 283, 284, and 285. Accordingly, at first, the reverse transportation roller pairs 282, 283, and 284 rotate to transport the sheet 1 toward a reverse sheet supply sensor 34 disposed at the rear side along the reverse path E.

In the embodiment, the reverse sheet supply sensor 34 is provided for detecting the sheet 1 supplied (transported) along the reverse path E. When the reverse sheet supply sensor 34 detects the leading edge of the sheet 1, the reverse sheet supply sensor 34 starts sending a reverse sheet supply detection signal (reverse sheet supply sensor ON) to the print control unit 110 through the control unit 101. When the trailing edge of the sheet 1 passes through the reverse sheet supply sensor 34, the reverse sheet supply sensor 34 stops sending the reverse sheet supply detection signal (reverse sheet supply OFF).

In the embodiment, after the sheet 1 passes through the reverse sheet supply sensor 34, the reverse transportation roller pair 285 rotates to transport the sheet 1 toward the reverse path F. Afterward, the sheet 1 transported along the reverse path F is transported toward the transportation path B once again through the register roller pair 23.

When the sheet 1 is transported toward the transportation path B, and the inlet sensor 22 detects the leading edge of the sheet 1 once again, the second surface of the sheet 1 faces upwardly, and the first surface of the sheet 1 on which the printing operation is performed already faces downwardly. Afterward, when the sheet 1 passes through the image forming portion 25 and the image fixing portion 27 while the second surface thereof faces upwardly, similar to the first surface, the printing operation is performed on the second surface of the sheet 1. After the printing operation is performed on the second surface, the sheet 1 passes through the reverse path switching lever 281 situated at the regular position and is transported toward the discharge portion 30 along the transportation path C.

In the embodiment, when the discharge sensor 29 detects the leading edge of the sheet 1 having the both surfaces printed and transported toward the transportation path C (discharge sensor ON), the print control unit 110 controls the drive unit to rotate the discharge roller pairs 301 and 302 in the forward direction. Accordingly, the discharge roller pairs 301 and 302 rotate to transport the sheet 1 with the both surfaces printed toward the pullout sensor 31 disposed at the rear side along the transportation path C.

In the embodiment, when the pullout sensor 31 detects the leading edge of the sheet with the both surfaces printed transported toward the transportation path C (pullout sensor ON), the print control unit 110 controls the drive unit to continuously rotate the discharge roller pairs 301 and 302 in the forward direction. At this moment, the duplex printing operation is performed on the both surfaces of the sheet 1. Accordingly, the print control unit 110 does not set the medium feed time as the counter value of the counter portion 1101. As a result, the sheet 1 is transported toward the discharge outlet 303.

In the embodiment, after the sheet 1 with the both surfaces printed is transported toward the discharge outlet 303, the discharge roller pairs 301 and 302 rotating in the forward direction discharge the sheet 1 from the discharge outlet 303. When the trailing edge of the sheet 1 discharged from the discharge outlet 303 passes through the pullout sensor 31 (pullout sensor OFF), the print control unit 110 controls the drive unit to stop the discharge roller pairs 301 and 302. After the sheet 1 with the both surfaces printed passes through the pullout sensor 31, the sheet 1 is discharged outside the printing apparatus 100 and placed on the discharge stacker 32.

Figure 1:
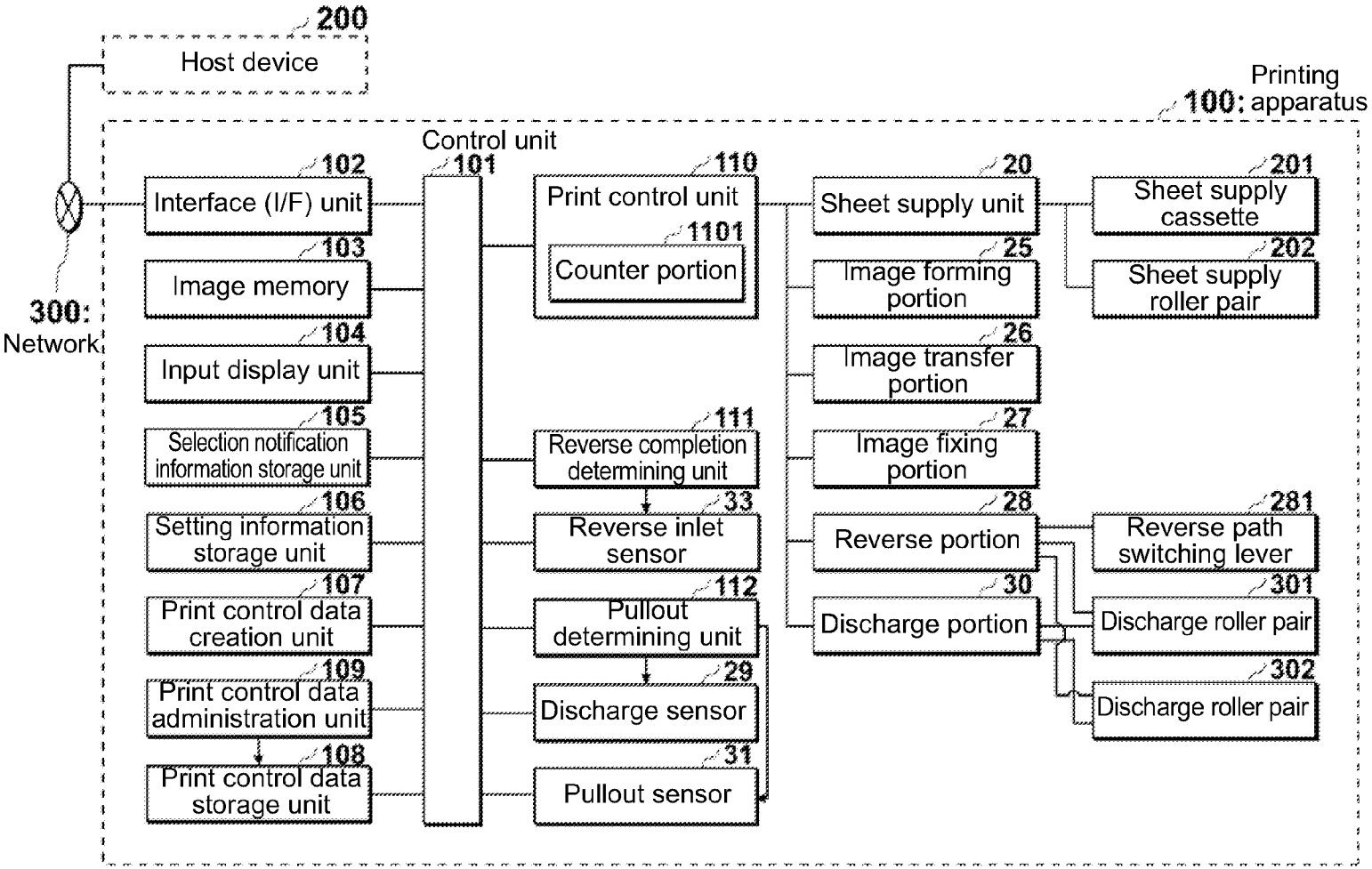
FIG. 1 is a block diagram showing a configuration of a control system of a printing apparatus according to a first embodiment of the present invention.

A configuration of the control system of the printing apparatus 100 will be explained next. FIG. 1 is a block diagram showing the configuration of the control system of the printing apparatus 100 according to the first embodiment of the present invention.

As shown in FIG. 1, the control system of the printing apparatus 100 includes the control unit 101 for controlling an entire operation of the printing apparatus 100; an interface (I/F) unit 102 for communicating with a host device 200 through a network 300; the image memory 103; an input display unit 104; a selection notification information storage unit 105; the setting information storage unit 106; a print control data creation unit 107; a print control data storage unit 108; a print control data administration unit 109; the print control unit 110; a reverse completion determining unit 111; and a pullout determining unit 112.

Figure 4:
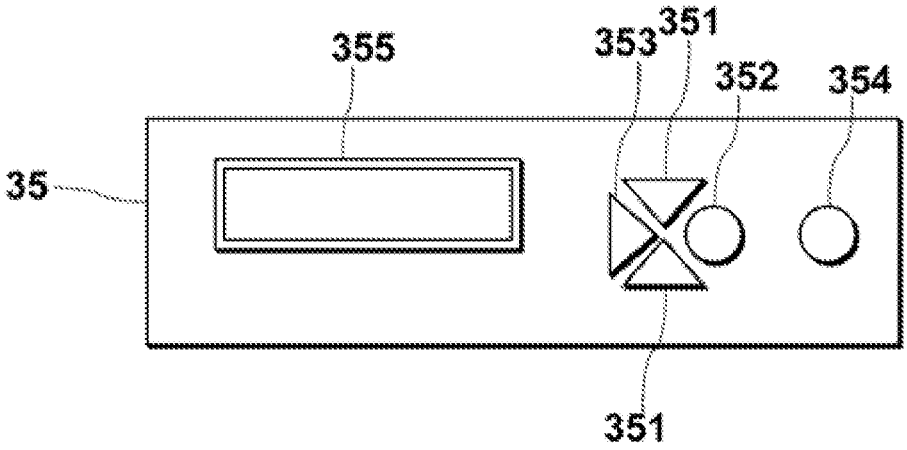
FIG. 4 is a schematic view showing an operation panel of the printing apparatus according to the first embodiment and the second embodiment of the present invention.

FIG. 4 is a schematic view showing an operation panel 35 of the printing apparatus 100 according to the first embodiment of the present invention.

In the embodiment, the input display unit 104 includes the operation panel 35, so that an operator operates the printing apparatus 100 through the operation panel 35. As shown in FIG. 4, the operation panel 35 includes a menu key 351 for inputting various instructions; an enter key 352; a return key 353; a cancel key 354; and a display 355 for displaying various notification information to the operator. As shown in FIG. 2, the operation panel 35 is disposed at an upper portion of the printing apparatus 100. Note that the operation panel 35 constitutes an operation unit, and the display 355 constitutes a display unit.

In the embodiment, the selection notification information storage unit 105 stores selection notification information in advance. With the selection notification information, the operator selects one of three modes, i.e., a first mode in which an image to be printed on the second surface of the sheet 1 pulled out is printed on one side of a next sheet in a single side printing operation, and a subsequent image is sequentially printed in the duplex printing operation; a second mode in which an image to be printed on the second surface of the sheet 1 pulled out is sequentially printed in the duplex printing operation; and a third mode in which an image to be printed on the second surface of the sheet 1 pulled out is sequentially printed in the single side printing operation. The selection notification information will be explained in more detail later with reference to FIG. 5.

In the embodiment, the operator operates the menu key 351 in the operation panel 35 of the input display unit 104 to select one of the three modes, i.e., a printing order after the sheet 1 is pulled out. The operator selects the printing order before the printing operation starts. Alternatively, the operator may select the printing order when the sheet 1 is pulled out.

Figure 5:
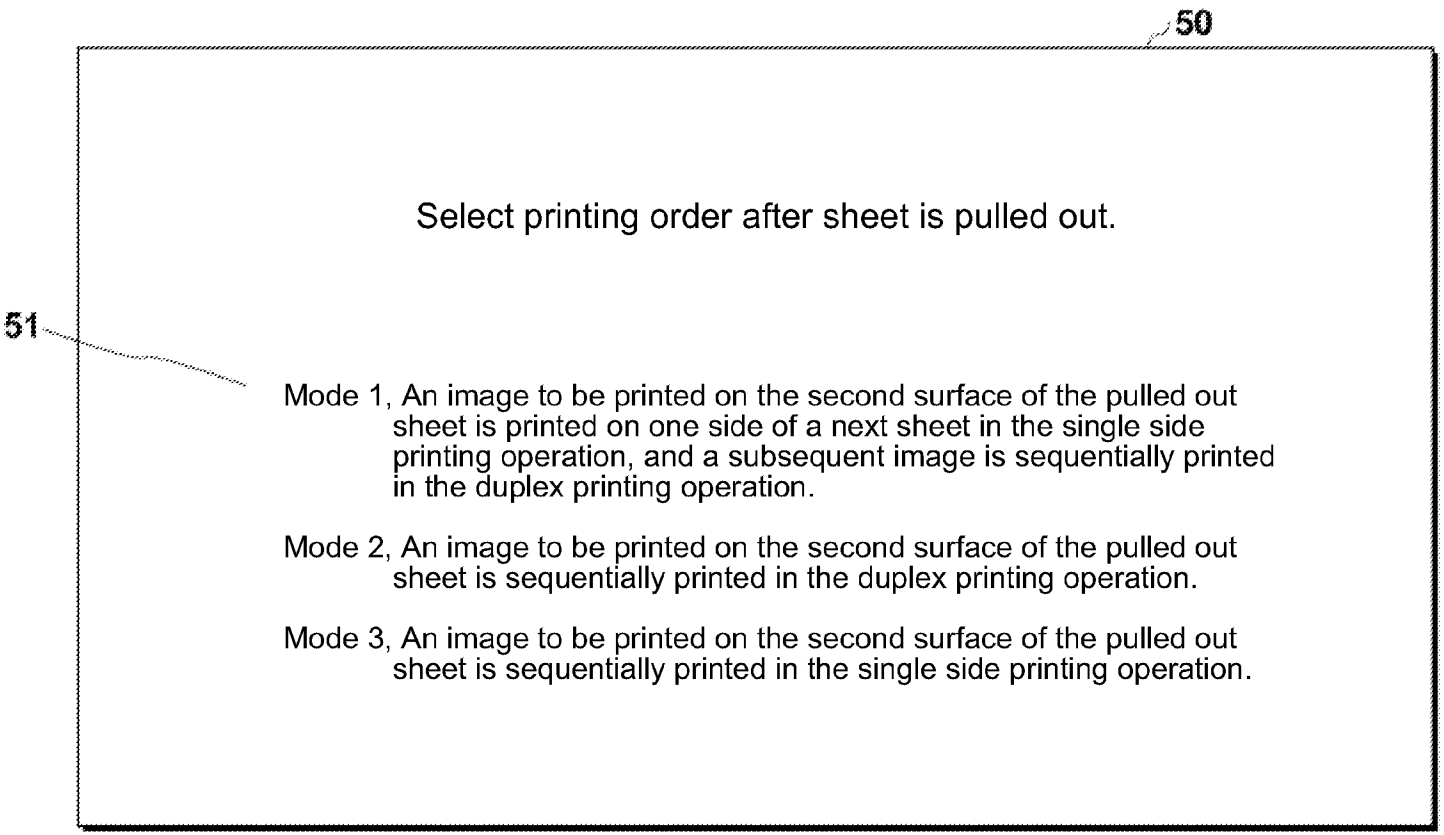
FIG. 5 is a schematic view showing an example of selection notification information according to the first embodiment of the present invention.

FIG. 5 is a schematic view showing an example of the selection notification information according to the first embodiment of the present invention. When the control unit 101 receives the instruction of setting the printing order after the sheet 1 is pulled out, the control unit 101 displays the selection notification information stored in the selection notification information storage unit 105 in a form 50 shown in FIG. 5 on the display 355 in the operation panel 35 of the input display unit 104.

As shown in FIG. 5, the form 50 includes a message 51 showing the three modes for setting the printing order after the sheet 1 is pulled out, namely, "Mode 1, an image to be printed on the second surface of the pulled out sheet is printed on one side of a next sheet in the single side printing operation, and a subsequent image is sequentially printed in the duplex printing operation"; "Mode 2, an image to be printed on the second surface of the pulled out sheet is sequentially printed in the duplex printing operation"; and "Mode 3, an image to be printed on the second surface of the pulled out sheet is sequentially printed in the single side printing operation".

In the embodiment, the operator refers to the form 50 displayed on the display 355, and operates the menu key 351. When the operator selects "Mode 1, an image to be printed on the second surface of the pulled out sheet is printed on one side of a next sheet in the single side printing operation, and a subsequent image is sequentially printed in the duplex printing operation", and pushes the return key 352, the print control unit 110 generates after pullout printing order information indicating "the single side printing operation on one sheet, the duplex printing operation on subsequent sheets", and sends the after pullout printing order information to the control unit 101.

In the embodiment, when the operator selects "Mode 2, an image to be printed on the second surface of the pulled out sheet is sequentially printed in the duplex printing operation", and pushes the return key 352, the print control unit 110 generates the after pullout printing order information indicating "the duplex printing operation on subsequent sheets", and sends the after pullout printing order information to the control unit 101.

In the embodiment, when the operator selects "Mode 3, an image to be printed on the second surface of the pulled out sheet is sequentially printed in the single side printing operation", the print control unit 110 generates the after pullout printing order information indicating "the single side printing operation on subsequent sheets", and sends the after pullout printing order information to the control unit 101.

In the embodiment, the setting information storage unit 106 stores various setting information to be used with the print control unit 110 for controlling the printing operation thereof. More specifically, the setting information storage unit 106 stores the after pullout printing order information, the medium feed time, and a reverse maximum time (described later).

In the embodiment, when the control unit 101 receives the after pullout printing order information, the control unit 101 stores the after pullout printing order information indicating "the single side printing operation on one sheet, the duplex printing operation on subsequent sheets", "the duplex printing operation on subsequent sheets", or "the single side printing operation on subsequent sheets" in the setting information storage unit 106. The setting information storage unit 106 is formed of a non-volatile memory. Accordingly, even after a power source (not shown) of the printing apparatus 100 is turned off, the setting information storage unit 106 is capable of holding data stored therein.

In the embodiment, the operator can operate the operation panel 35 to change the after pullout printing order information stored in the setting information storage unit 106 at any time. Further, the setting information storage unit 106 stores the after pullout printing order information indicating one of "the single side printing operation on one sheet, the duplex printing operation on subsequent sheets", "the duplex printing operation on subsequent sheets" and "the single side printing operation on subsequent sheets" in advance as default setting information.

In the embodiment, when the control unit 101 receives print data from the host device 200 through the interface (I/F) unit 102, the control unit 101 controls a rasterization conversion unit (not shown) of the printing apparatus 100 to convert the print data to image data. The print data include printing operation instruction information indicating the single side printing operation and the duplex printing operation. The image data is provided with the printing operation instruction information included in the print data. When the control unit 101 stores the image data in the image memory 103, the control unit 101 instructs the print control data creation unit 107 to create print control data.

Figure 6:
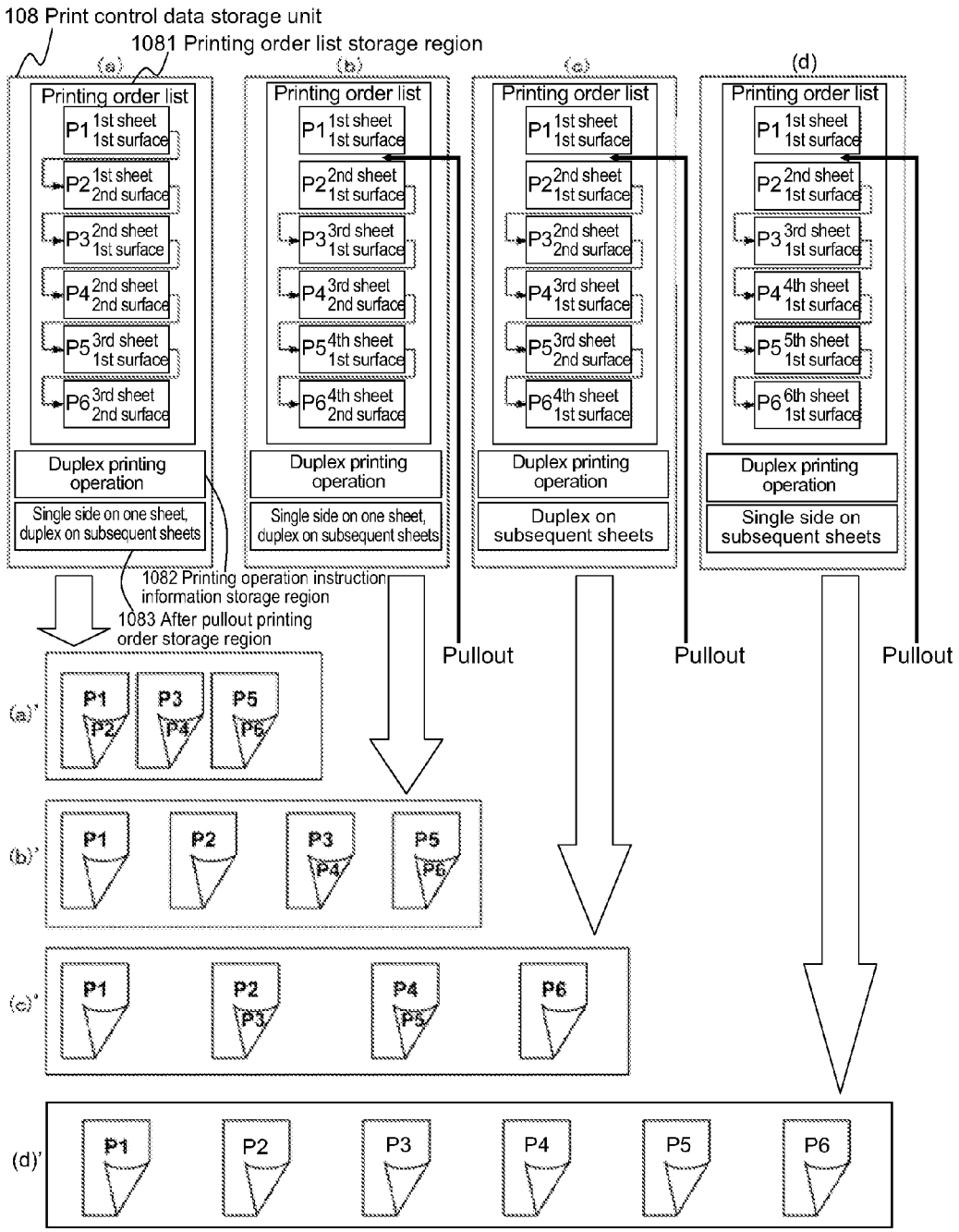
FIG. 6 is a schematic view showing a configuration of print control data and an example of a print output result according to the first embodiment of the present invention.

FIG. 6 is a schematic view showing a configuration of the print control data and an example of a print output result according to the first embodiment of the present invention. The print control data shown in FIG. 6 are an example in the case of the duplex printing operation.

In the embodiment, the print control data creation unit 107 is provided for creating the print control data to be used with the printing apparatus 100 for the printing operation. More specifically, when the control unit 101 instructs the print control data creation unit 107 to create the print control data, the print control data creation unit 107 creates the print control data having an initial printing order (a) according to the image data (attached with the printing operation instruction information indicating the one side printing operation or the duplex printing operation) stored in the image memory 103 and the after pullout printing order information stored in the setting information storage unit 106 indicating one of "the single side printing operation on one sheet, the duplex printing operation on subsequent sheets" and "the duplex printing operation on subsequent sheets".

In the print control data having the initial printing order (a) shown in FIG. 6, each odd number page of the image data is printed on the first surface of each sheet, and each even number page of the image data is printed on the second surface of each sheet. As shown in FIG. 6, when the sheet 1 is not pulled out, each odd number page of the image data is printed on the first surface of the sheet 1, and each even number page of the image data is printed on the second surface of the sheet 1.

In the embodiment, when the print control data creation unit 107 creates the print control data, the control unit 101 instructs the print control data administration unit 109 to register the print control data, and the control unit 101 sends the print control data to the print control data administration unit 109.

As shown in FIG. 6, the print control data storage unit 108 includes a printing order list storage region 1081 for storing a printing order list indicating the printing order of the image data; a printing operation instruction information storage region 1082 for storing the printing operation instruction information; and an after pullout printing order storage region 1083 for storing the after pullout printing order information.

In the embodiment, the print control data administration unit 109 is an administration unit for administrating the print control data stored in the print control data storage unit 108. When the print control data administration unit 109 receives the print control data along with the instruction to register the print control data, the print control data administration unit 109 stores the print control data in the print control data storage unit 108.

More specifically, the print control data administration unit 109 stores in the printing order list storage region 1081 the printing order list indicating the initial printing order (a), in which each odd number page of the image data is printed on the first surface of each sheet, and each even number page of the image data is printed on the second surface of each sheet. Further, the print control data administration unit 109 stores in the printing operation instruction information storage region 1082 the printing operation instruction information indicating the single side printing operation or the duplex printing operation. Further, the print control data administration unit 109 stores in the after pullout printing order storage region 1083 the after pullout printing order information indicating one of "the single side printing operation on one sheet, the duplex printing operation on subsequent sheets" and "the duplex printing operation on subsequent sheets".

In the embodiment, when the print control data administration unit 109 stores the print control data in the print control data storage unit 108, the control unit 101 instructs the print control unit 110 to perform the printing operation.

In the embodiment, the print control unit 110 controls the printing operation according to the print control data stored in the print control data storage unit 108 and the image data stored in the image memory 103. In other words, the print control unit 110 controls each component of a printer engine. The printer engine is formed of the sheet supply unit 20, the image forming portion 25, the image transfer portion 26, the image fixing portion 27, the reverse portion 28, and the discharge portion 30 as shown in FIG. 1.

More specifically, when the print control unit 110 receives the instruction of the printing operation, the print control unit 110 controls the drive unit to rotate the sheet supply roller pair 202 to transport the sheet 1 placed at the uppermost position in the sheet supply cassette 201. Further, the control unit 101 sequentially retrieves the image data corresponding to each page in the printing order list from the image memory 103 according to the printing order list stored in the printing order list storage region 1081, thereby performing the duplex printing operation.

In the embodiment, the case that the printing apparatus 100 performs the duplex printing operation or the single side printing operation will be explained. As described above, the print control unit 110 controls each component of the printer engine for performing the duplex printing operation on the sheet 1.

In the embodiment, after the printing operation is performed on the first surface of the sheet 1, the print control unit 110 controls the drive unit to rotate the discharge roller pairs 301 and 302 in the reverse direction, so that the sheet 1 is pulled back to the printing apparatus 100 to be reversed. At the same time, the print control unit 110 retrieves the reverse maximum time set in advance in the setting information storage unit 106 through the control unit 101.

Afterward, the print control unit 110 sets the reverse maximum time thus obtained as the counter value of the counter portion 1101 of the print control unit 110, so that the counter portion 1101 starts counting down the counter value. At the same time, the print control unit 110 instructs the reverse completion determining unit 111 to determine whether the sheet 1 is completely reversed. When the counter value becomes zero, the print control unit 110 sends an elapse signal indicating that the reverse maximum time is elapsed to the reverse completion determining unit 111 through the control unit 101. The reverse maximum time is calculated according to experimental data at a manufacture of the printing apparatus 100, and is stored in the setting information storage unit 106.

In the embodiment, the reverse completion determining unit 111 is provided for determining whether the sheet 1 is completely transported to the reverse path (a reverse process is completed) according to an ON/OFF state of the reverse inlet sensor 33 obtained through the control unit 101 and whether the reverse maximum time is elapsed.

More specifically, when the reverse completion determining unit 111 receives the instruction to determine whether the sheet 1 is completely reversed, the reverse completion determining unit 111 determines that the sheet 1 is completely reversed when the reverse completion determining unit 111 receives the reverse inlet detection signal from the reverse inlet sensor 33 (reverse inlet sensor ON) indicating that the leading edge of the sheet 1 passes through the reverse inlet sensor 33.

On the other hand, when the reverse completion determining unit 111 receives the instruction to determine whether the sheet 1 is completely reversed while the reverse completion determining unit 111 does not receive the reverse inlet detection signal from the reverse inlet sensor 33 (reverse inlet sensor OFF) indicating that the sheet 1 does not reach the reverse path E, the reverse completion determining unit 111 determines that the sheet 1 is not completely reversed.

In the embodiment, when the reverse completion determining unit 111 determines that the sheet 1 is completely reversed, the control unit 101 sends a determination result to the print control unit 110. When the print control unit 110 receives the determination result, the print control unit 110 controls the drive unit to rotate the reverse transportation roller pairs 282, 283, 284, and 285. Accordingly, after the leading edge of the sheet 1 passes through the reverse inlet sensor 33, the reverse transportation roller pairs 282, 283, 284, and 285 rotate to transport the sheet 1 toward the transportation path B through the register roller pair 23.

After the sheet 1 is reversed such that the second surface thereof faces upwardly, the print control unit 110 performs the printing operation on the second surface according to the image data of the next page in the print control data. After the print control unit 110 performs the duplex printing operation on the sheet 1, the print control unit 110 performs the printing operation according to the printing order list stored in the printing order list storage region 1081 until the print control unit 110 completes the printing operation according to the image data of all pages.

In the embodiment, when the reverse completion determining unit 111 determines that the sheet 1 is not completely reversed, the control unit 101 instructs the pullout determining unit 112 to determine whether the sheet 1 is pulled out. The pullout determining unit 112 is provided for determining whether the sheet 1 is pulled out according to an ON/OFF state of the pullout sensor 31 and the discharge sensor 29 obtained through the control unit 101.

More specifically, when the pullout determining unit 112 receives the instruction to determine whether the sheet 1 is pulled out, the pullout determining unit 112 determines that the sheet 1 is pulled out when the pullout sensor 31 and the discharge sensor 29 are in the OFF state indicating that the sheet 1 is not situated in the transportation path C and the reverse path D.

As described above, the pullout determining unit 112 determines whether the sheet 1 is pulled out according to the ON/OFF state of the pullout sensor 31. Alternatively, the pullout determining unit 112 may determine whether the sheet 1 is pulled out according to a switching time counted with the counter between the ON state of the pullout sensor 31 when the sheet 1 is discharged, the OFF state of the pullout sensor 31 when the sheet 1 passes there through, and the ON state of the pullout sensor 31 when the sheet 1 is pulled back.

In the embodiment, when at least one of the pullout sensor 31 and the discharge sensor 29 is in the ON state indicating that the sheet 1 is situated in the transportation path C, the pullout determining unit 112 determines that a jam occurs while the sheet 1 is pulled back.

In the embodiment, when the pullout determining unit 112 determines that the sheet 1 is pulled out, the control unit 101 sends a determination result to the print control unit 110, and instructs the print control data administration unit 109 to update the print control data. When the pullout determining unit 112 determines that the jam occurs while the sheet 1 is pulled back, the control unit 101 sends a determination result to the print control unit 110.

In the embodiment, when the print control unit 110 receives the determination result indicating that the jam occurs while the sheet 1 is pulled back, the print control unit 110 stops each component of the printer engine, and displays jam occurrence notification information on the display 355 of the operation panel 35. Accordingly, the operation refers to the jam occurrence notification information displayed on the display 355, and opens a cover of the printing apparatus 100 to remove the jam. After the operation removes the jam, the operator closes the cover.

In the embodiment, the control unit 101 detects whether the cover is opened or closed through a sensor (not shown). When the control unit 101 determines that the jam does not exist in the printing apparatus 100 through the ON/OFF state of various sensors, the control unit 101 instructs the print control unit 110 to resume the printing operation. When the print control unit 110 receives the instruction to resume the printing operation, the print control unit 110 resumes the printing operation according to the printing order list stored in the printing order list storage region 1081.

In the embodiment, when the print control data administration unit 109 receives the instruction to update the print control data, the print control data administration unit 109 updates the printing order list indicating the initial printing order (a) to the printing order list indicating a printing order (b) shown in FIG. 6 when the after pullout printing order information stored in the after pullout printing order storage region 1083 indicates "the single side printing operation on one sheet, the duplex printing operation on subsequent sheets".

In the printing order list indicating the printing order (b) shown in FIG. 6, the image data of the page to be printed on the second surface of the sheet 1 pulled out are printed on a first surface of a next sheet in the single side printing operation. Afterward, the duplex printing operation is performed, so that each odd number page of the image data is printed on the first surface of each sheet, and each even number page of the image data is printed on the second surface of each sheet.

In the embodiment, when the after pullout printing order information stored in the after pullout printing order storage region 1083 indicates "the duplex printing operation on subsequent sheets", the print control data administration unit 109 updates the printing order list indicating the initial printing order (a) to the printing order list indicating a printing order (c) shown in FIG. 6.

In the printing order list indicating the printing order (c) shown in FIG. 6, the image data of the page to be printed on the second surface of the sheet 1 pulled out are printed on a first surface of a next sheet in the single side printing operation. Afterward, the duplex printing operation is performed, so that each odd number page of the image data is printed on the second surface of each sheet, and each even number page of the image data is printed on the first surface of each sheet.

In the embodiment, when the after pullout printing order information stored in the after pullout printing order storage region 1083 indicates "the single side printing operation on subsequent sheets", the print control data administration unit 109 updates the printing order list indicating the initial printing order (a) to the printing order list indicating a printing order (d) shown in FIG. 6.

In the printing order list indicating the printing order (d) shown in FIG. 6, the image data of the page to be printed on the second surface of the sheet 1 pulled out are printed on a first surface of a next sheet in the single side printing operation. Afterward, the single side printing operation is performed, so that each page of the image data is printed on each sheet.

In the embodiment, after the print control data administration unit 109 updates the print control data, the control unit 101 notifies the print control unit 110 that the print control data is completely updated. When the print control unit 110 receives the determination result that the sheet 1 is pulled out and the notification that the update of the print control data is completed, the print control unit 110 controls the drive unit to rotate the sheet supply roller pair 202 to transport the a next sheet 1 as the next sheet from the sheet supply cassette 201 according to the print control data thus updated and stored in the print control data storage unit 108. Accordingly, the print control unit 110 retrieves the image data to be printed on the sheet 1 from the image memory 103, thereby performing the printing operation.

At this moment, when the print control unit 110 performs the printing operation according to the printing order list indicating the printing order (b) shown in FIG. 6, a print result (b)' shown in FIG. 6 is obtained. In the print result (b)', the image data of the page to be printed on the second surface of the sheet 1 pulled out are printed on the first surface of the next sheet in the single side printing operation. Afterward, the duplex printing operation is performed, so that each odd number page of the image data is printed on the first surface of each sheet, and each even number page of the image data is printed on the second surface of each sheet.

Further, when the print control unit 110 performs the printing operation according to the printing order list indicating the printing order (c) shown in FIG. 6, a print result (c)' shown in FIG. 6 is obtained. In the print result (c)', the image data of the page to be printed on the second surface of the sheet 1 pulled out are printed on a first surface of a next sheet in the single side printing operation. Afterward, the duplex printing operation is performed, so that each odd number page of the image data is printed on the second surface of each sheet, and each even number page of the image data is printed on the first surface of each sheet.

Further, when the print control unit 110 performs the printing operation according to the printing order list indicating the printing order (d) shown in FIG. 6, a print result (d)' shown in FIG. 6 is obtained. In the print result (d)', the image data of the page to be printed on the second surface of the sheet 1 pulled out are printed on a first surface of a next sheet in the single side printing operation. Afterward, the single side printing operation is performed, so that each page of the image data is printed on each sheet.

Figure 7:
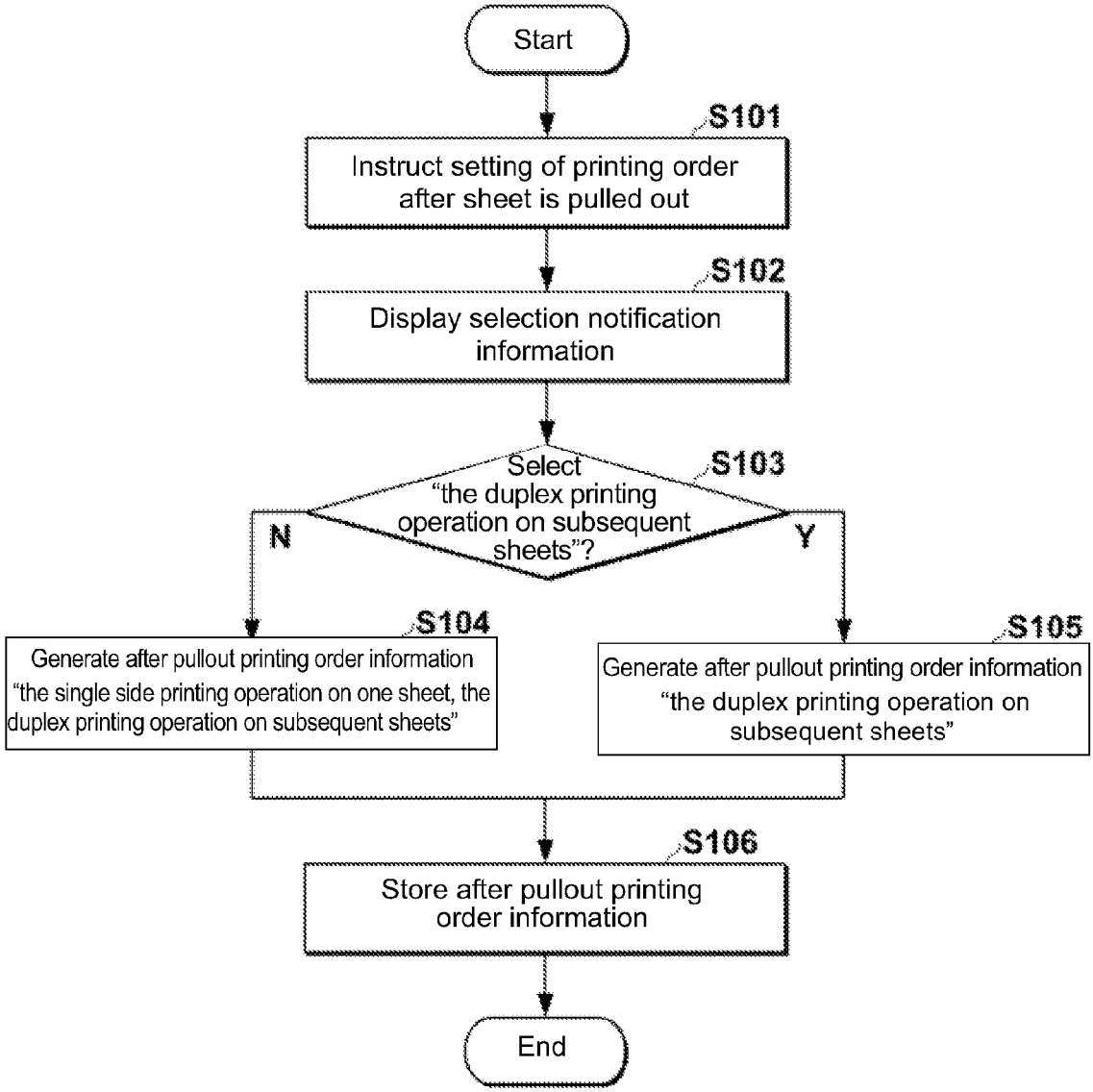
FIG. 7 is a flow chart showing an operation of the printing apparatus when a printing order is set after a sheet is pulled out according to the first embodiment of the present invention.

An operation of the printing apparatus 100 will be explained next with reference to a flow chart shown in FIG. 7. FIG. 7 is the flow chart showing the operation of the printing apparatus 100 when the printing order is set after the sheet 1 is pulled out according to the first embodiment of the present invention.

In step S101, the operator operates the menu key 351 in the operation panel 35 of the printing apparatus 100 to instruct the setting of the printing order after the sheet 1 is pulled out. In step S102, when the control unit 101 receives the instruction, the control unit 101 displays the selection notification information as the form 50 shown in FIG. 5 on the display 355 in the operation panel 35.

In step S103, it is determined whether the operator selects "the duplex printing operation on subsequent sheets". That is, the operator refers to the form 50 and operates the menu key 351 to select the printing order. In step S104, when the operator selects "Mode 1, an image to be printed on the second surface of the pulled out sheet is printed on one side of a next sheet in the single side printing operation, and a subsequent image is sequentially printed in the duplex printing operation" and pushes the return key 352, the print control unit 110 generates the after pullout printing order information indicating "the single side printing operation on one sheet, the duplex printing operation on subsequent sheets", and sends the after pullout printing order information to the control unit 101.

In step S105, when the operator selects "Mode 2, an image to be printed on the second surface of the pulled out sheet is sequentially printed in the duplex printing operation", and pushes the return key 352, the print control unit 110 generates the after pullout printing order information indicating "the duplex printing operation on subsequent sheets", and sends the after pullout printing order information to the control unit 101.

In step S106, when the control unit 101 receives the after pullout printing order information, the control unit 101 stores the after pullout printing order information indicating "the single side printing operation on one sheet, the duplex printing operation on subsequent sheets", "the duplex printing operation on subsequent sheets" or "the single side printing operation on subsequent sheets" in the setting information storage unit 106.

Figure 8:
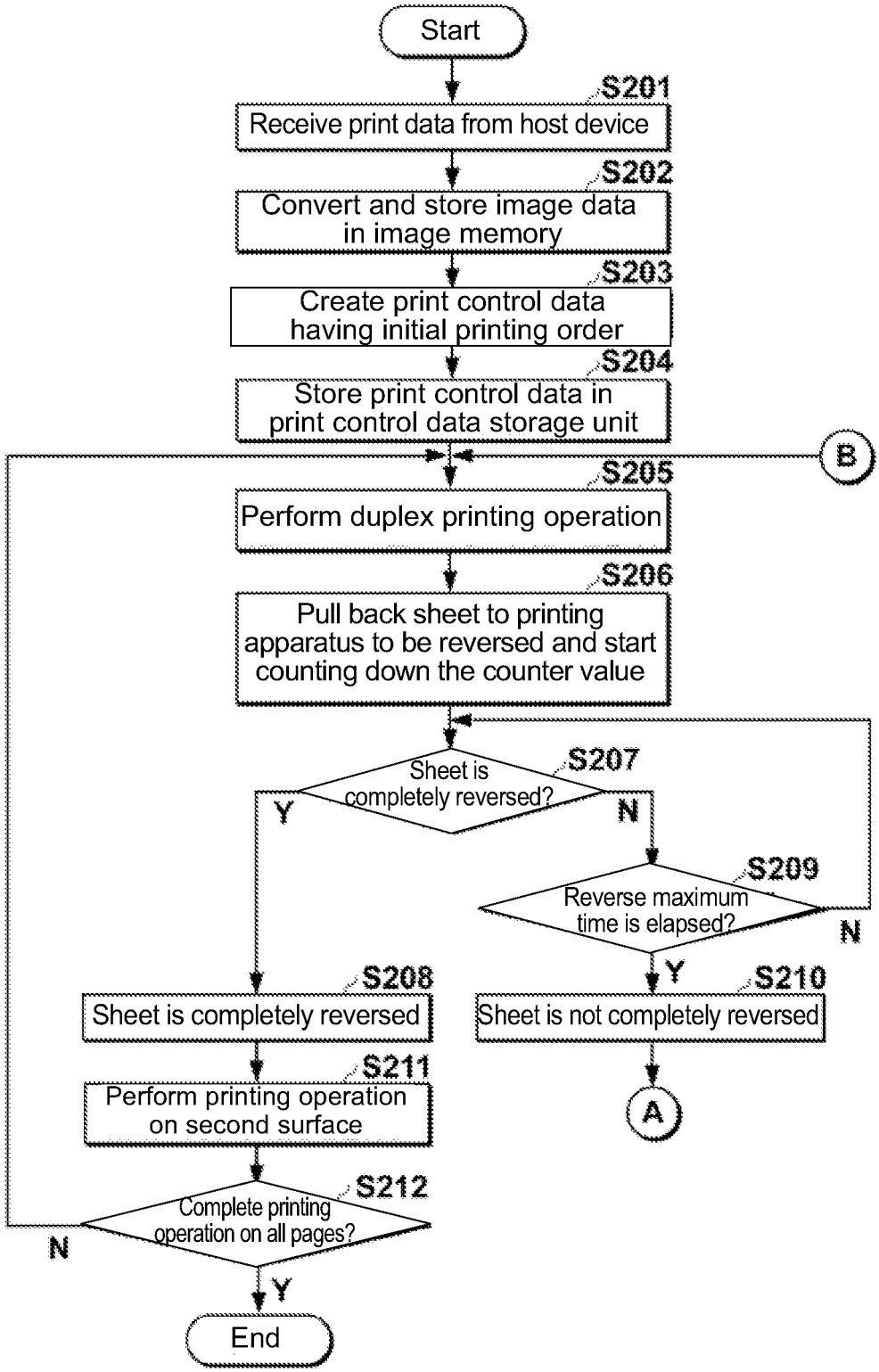
FIG. 8 is a flow chart No. 1 showing a duplex printing operation of the printing apparatus according to the first embodiment of the present invention.
Figure 9:
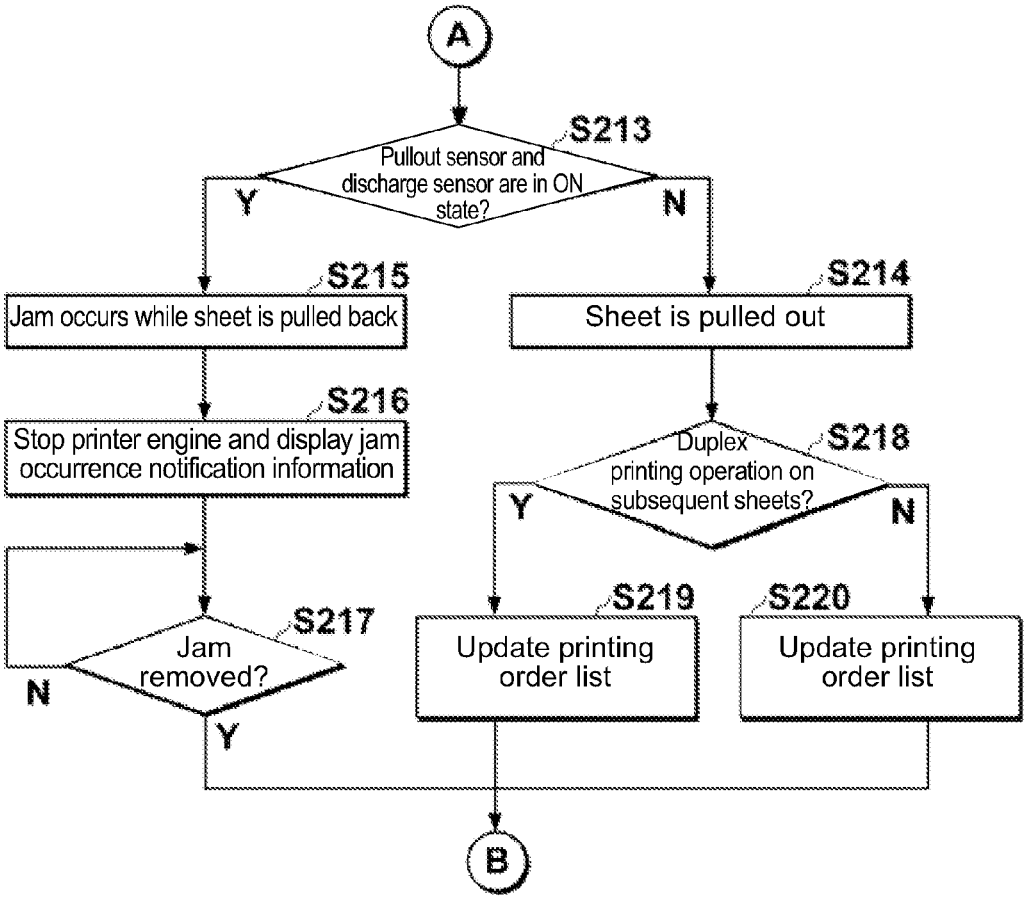
FIG. 9 is a flow chart No. 2 showing the duplex printing operation of the printing apparatus according to the first embodiment of the present invention.

The duplex printing operation of the printing apparatus 100 will be explained next with reference to flow charts shown in FIGS. 8 and 9. FIG. 8 is a flow chart No. 1 showing the duplex printing operation of the printing apparatus 100 according to the first embodiment of the present invention. FIG. 9 is a flow chart No. 2 showing the duplex printing operation of the printing apparatus 100 according to the first embodiment of the present invention. In step S201, when the control unit 101 of the printing apparatus 100 receives the print data from the host device 200 through the interface (I/F) unit 102, the control unit 101 controls the rasterization conversion unit of the printing apparatus 100 to convert the print data to the image data. The image data is provided with the printing operation instruction information included in the print data and indicating the duplex printing operation. In step S202, when the control unit 101 stores the image data in the image memory 103, the control unit 101 instructs the print control data creation unit 107 to create the print control data.

Figure 11:
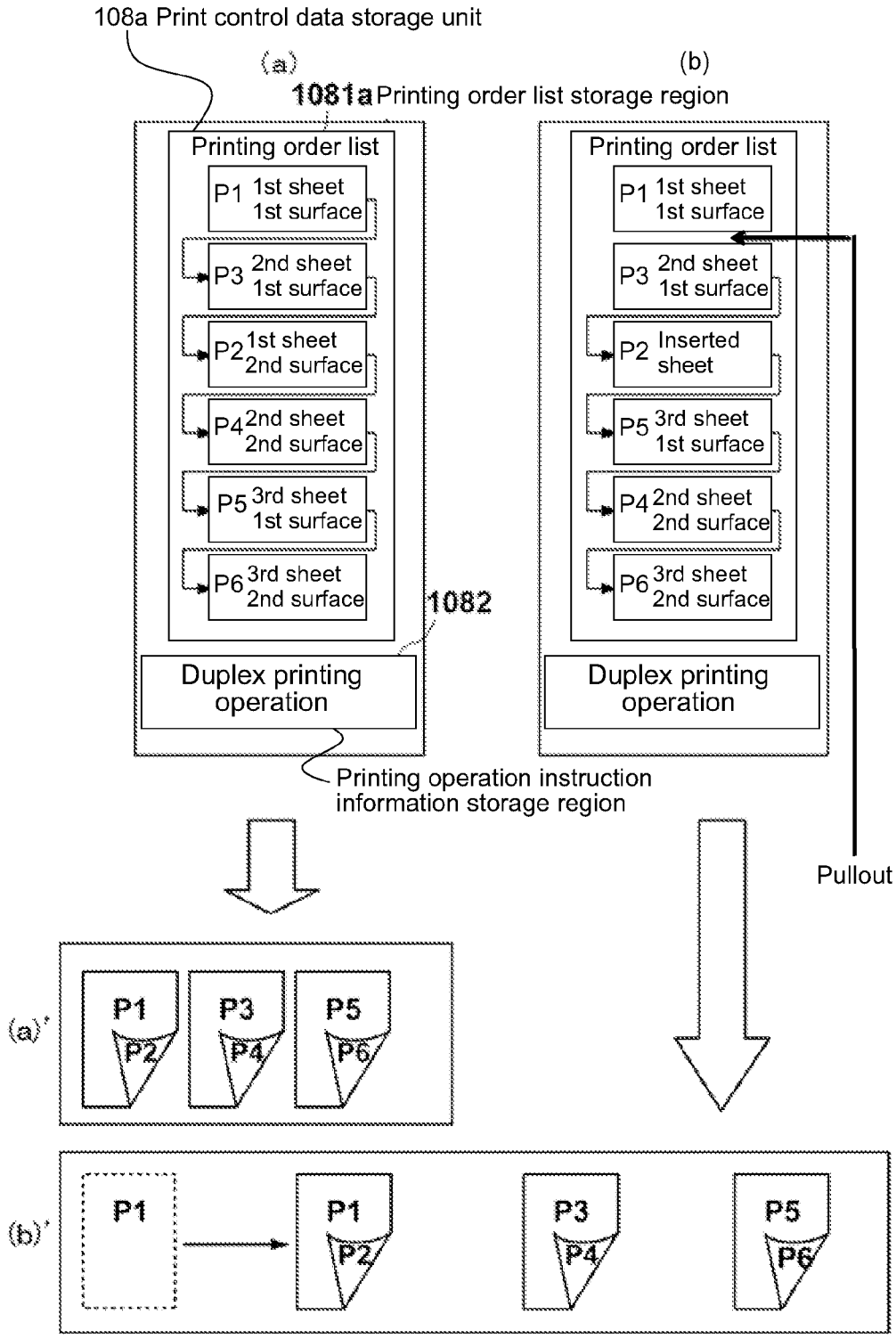
FIG. 11 is a schematic view showing a configuration of print control data and an example of a print output result according to the second embodiment of the present invention.

In step S203, when the control unit 101 instructs the print control data creation unit 107 to create the print control data, the print control data creation unit 107 creates the image data (attached with the printing operation instruction information indicating the duplex printing operation) stored in the image memory 103 and the print control data having the initial printing order (a) shown in FIG. 11.

In the print control data having the initial printing order (a), each odd number page (1, 3, 5 page) of the image data is printed on the first surface of each sheet, and each even number page (2, 4, 6 page) of the image data is printed on the second surface of each sheet.

In the next step, when the print control data creation unit 107 creates the print control data, the control unit 101 instructs the print control data administration unit 109 to register the print control data, and the control unit 101 sends the print control data to the print control data administration unit 109.

In step S204, when the print control data administration unit 109 receives the print control data along with the instruction to register the print control data, the print control data administration unit 109 stores the print control data in the print control data storage unit 108.

More specifically, the print control data administration unit 109 stores in the printing order list storage region 1081 the printing order list indicating the initial printing order (a) shown in FIG. 6, in which each odd number page (1, 3, 5 page) of the image data is printed on the first surface of each sheet, and each even number page (2, 4, 6 page) of the image data is printed on the second surface of each sheet. Further, the print control data administration unit 109 stores in the printing operation instruction information storage region 1082 the printing operation instruction information indicating the duplex printing operation. Further, the print control data administration unit 109 stores in the after pullout printing order storage region 1083 the after pullout printing order information indicating one of "the single side printing operation on one sheet, the duplex printing operation on subsequent sheets" and "the duplex printing operation on subsequent sheets".

In the next step, when the print control data administration unit 109 stores the print control data in the print control data storage unit 108, the control unit 101 instructs the print control unit 110 to perform the printing operation.

In step S205, when the print control unit 110 receives the instruction of the printing operation, the print control unit 110 controls the drive unit to rotate the sheet supply roller pair 202 to transport the sheet 1 placed at the uppermost position in the sheet supply cassette 201. Further, the control unit 101 sequentially retrieves the image data corresponding to the first page in the printing order list from the image memory 103 according to the printing order list stored in the printing order list storage region 1081, thereby performing the duplex printing operation.

In step S206, after the printing operation is performed on the first surface of the sheet 1 (the image data of the first page), the print control unit 110 controls the drive unit to rotate the discharge roller pairs 301 and 302 in the reverse direction, so that the sheet 1 is pulled back to the printing apparatus 100 to be reversed. At the same time, the print control unit 110 retrieves the reverse maximum time set in advance in the setting information storage unit 106 through the control unit 101.

Afterward, the print control unit 110 sets the reverse maximum time thus obtained as the counter value of the counter portion 1101 of the print control unit 110, so that the counter portion 1101 starts counting down the counter value. At the same time, the print control unit 110 instructs the reverse completion determining unit 111 to determine whether the sheet 1 is completely reversed. When the counter value becomes zero, the print control unit 110 sends the elapse signal indicating that the reverse maximum time is elapsed to the reverse completion determining unit 111 through the control unit 101.

In step S207, when the reverse completion determining unit 111 receives the instruction to determine whether the sheet 1 is completely reversed, the reverse completion determining unit 111 determines whether the sheet 1 is completely reversed. In step S208, when the reverse completion determining unit 111 receives the reverse inlet detection signal from the reverse inlet sensor 33 (reverse inlet sensor ON), the reverse completion determining unit 111 determines that the sheet 1 is completely reversed.

In step S209, when the reverse completion determining unit 111 receives the instruction to determine whether the sheet 1 is completely reversed while the reverse completion determining unit 111 does not receive the reverse inlet detection signal from the reverse inlet sensor 33 (reverse inlet sensor OFF), it is determined whether the reverse maximum time is elapsed. In step S210, when the reverse maximum time is elapsed, the reverse completion determining unit 111 determines that the sheet 1 is not completely reversed.

When the reverse completion determining unit 111 determines that the sheet 1 is completely reversed, the control unit 101 sends the determination result to the print control unit 110. When the print control unit 110 receives the determination result that the sheet 1 is completely reversed, the print control unit 110 controls the drive unit to rotate the reverse transportation roller pairs 282, 283, 284, and 285. Accordingly, after the leading edge of the sheet 1 passes through the reverse inlet sensor 33, the reverse transportation roller pairs 282, 283, 284, and 285 rotate to transport the sheet 1 toward the transportation path B through the register roller pair 23.

In step S211, after the sheet 1 is reversed such that the second surface thereof faces upwardly, the print control unit 110 performs the printing operation on the second surface according to the image data of the next page (the second page) in the print control data. After the print control unit 110 performs the duplex printing operation on the sheet 1, the print control unit 110 performs the printing operation according to the printing order list until the print control unit 110 completes the printing operation according to the image data of 6 page. In step S212, it is determined whether the print control unit 110 completes the printing operation on all pages. When it is determined that the print control unit 110 completes the printing operation on all pages, the process is completed.

When the reverse completion determining unit 111 determines that the sheet 1 is not completely reversed, the control unit 101 instructs the pullout determining unit 112 to determine whether the sheet 1 is pulled out. In step S213, when the pullout determining unit 112 receives the instruction to determine whether the sheet 1 is pulled out, the pullout determining unit 112 determines whether the sheet 1 is pulled out. In step S214, when the pullout sensor 31 and the discharge sensor 29 are in the OFF state indicating that the sheet 1 is not situated in the transportation path C and the reverse path D, the pullout determining unit 112 determines that the sheet 1 is pulled out.

In step S215, when at least one of the pullout sensor 31 and the discharge sensor 29 is in the ON state indicating that the sheet 1 is situated in the transportation path C, the pullout determining unit 112 determines that a jam occurs while the sheet 1 is pulled back. When the pullout determining unit 112 determines that the sheet 1 is pulled out, the control unit 101 sends the determination result to the print control unit 110, and instructs the print control data administration unit 109 to update the print control data. When the pullout determining unit 112 determines that the jam occurs while the sheet 1 is pulled back, the control unit 101 sends the determination result to the print control unit 110.

In step S216, when the print control unit 110 receives the determination result indicating that the jam occurs while the sheet 1 is pulled back, the print control unit 110 stops each component of the printer engine, and displays the jam occurrence notification information on the display 355 of the operation panel 35. Accordingly, the operation refers to the jam occurrence notification information displayed on the display 355, and opens the cover of the printing apparatus 100 to remove the jam. After the operation removes the jam, the operator closes the cover.

In step S217, the control unit 101 detects whether the cover is opened or closed through the sensor (not shown). When the control unit 101 determines that the jam does not exist in the printing apparatus 100 through the ON/OFF state of the various sensors, the control unit 101 instructs the print control unit 110 to resume the printing operation. When the print control unit 110 receives the instruction to resume the printing operation, the print control unit 110 resumes the printing operation according to the printing order list stored in the printing order list storage region 1081.

In step S218, when the print control data administration unit 109 receives the instruction to update the print control data, the print control data administration unit 109 determines whether the after pullout printing order information indicates the duplex printing operation on subsequent sheets. In step S219, when the after pullout printing order information stored in the after pullout printing order storage region 1083 indicates "the single side printing operation on one sheet, the duplex printing operation on subsequent sheets", the print control data administration unit 109 updates the printing order list indicating the initial printing order (a) to the printing order list indicating a printing order (b) shown in FIG. 6.

In the printing order list indicating the printing order (b), the image data of 2 page to be printed on the second surface of the sheet 1 pulled out are printed on the first surface of the second sheet in the single side printing operation. Afterward, the duplex printing operation is performed, so that each odd number page (3, 5 page) of the image data is printed on the first surface of each sheet, and each even number page (4, 6 page) of the image data is printed on the second surface of each sheet.

In step S220, when the after pullout printing order information stored in the after pullout printing order storage region 1083 indicates "the duplex printing operation on subsequent sheets", the print control data administration unit 109 updates the printing order list indicating the initial printing order (a) to the printing order list indicating a printing order (c) shown in FIG. 6.

In the printing order list indicating the printing order (c), the image data of 2 page to be printed on the second surface of the sheet 1 pulled out are printed on the first surface of the next sheet in the single side printing operation. Afterward, the duplex printing operation is performed, so that each odd number page (3, 5 page) of the image data is printed on the second surface of each sheet, and each even number page (4, 6 page) of the image data is printed on the first surface of each sheet.

In the next step, after the print control data administration unit 109 updates the print control data, the control unit 101 notifies the print control unit 110 that the update of the print control data is completed. When the print control unit 110 receives the determination result that the sheet 1 is pulled out and the notification that the update of the print control data is completed, the print control unit 110 controls the drive unit to rotate the sheet supply roller pair 202 to transport the sheet 1 as the next sheet from the sheet supply cassette 201 according to the print control data thus updated and stored in the print control data storage unit 108. Accordingly, the print control unit 110 retrieves the image data to be printed on the sheet 1 from the image memory 103, thereby performing the printing operation.

As described above, in the embodiment, when the printing apparatus 100 performs the duplex printing operation, the discharge roller pairs 301 and 302 rotate in the reverse direction, so that the sheet 1 is pulled back to the printing apparatus 100 to be reversed. After the reverse maximum time is elapsed, when the reverse inlet sensor 33 does not detect the sheet 1 (the sheet 1 is completely reversed), and the pullout sensor 31 and the discharge sensor 29 are in the OFF state, it is determined that the sheet 1 is pulled out, thereby making it possible to detect that the sheet 1 is pulled out. Further, it is possible to continue the printing operation according to the after pullout printing order information set in advance by the operator through the input display unit 104.

Further, in the embodiment, the printing apparatus 100 is capable of obtaining the desired print out result except the sheet 1 pulled out.

Second Embodiment

A second embodiment of the present invention will be explained. In the first embodiment, when the printing apparatus 100 performs the duplex printing operation, the printing operation is performed on only one side (the first surface) of the sheet 1 when the sheet 1 is pulled out. Accordingly, it is difficult to obtain the print out result the operator desired.

In the second embodiment, a printing apparatus 100*a* has a configuration different from the printing apparatus 100 in the first embodiment. In the printing apparatus 100*a*, when the reverse completion determining unit 111 detects that the sheet 1 is pulled out, the sheet 1 is placed on the manual tray 36 such that the second surface of the sheet 1 faces upwardly. Then, the image data to be printed are printed on the second surface of the sheet 1, thereby making it possible to obtain the desired print out result.

In the first embodiment, when the printing apparatus 100 performs the duplex printing operation, the next sheet is transported after the duplex printing operation is performed on the sheet 1. In the second embodiment, the printing apparatus 100*a* is configured so that two sheets are sequentially transported, thereby increasing a speed of the duplex printing operation. More specifically, the printing operation is sequentially performed on the first surfaces of the two sheets. After the two sheets are sequentially reversed, the printing operation is sequentially performed on the second surfaces of the two sheets.

A configuration of the printing apparatus 100*a* will be explained with reference to FIG. 2. Explanations of components of the printing apparatus 100*a* similar to those of the printing apparatus 100 are omitted.

Figure 10:
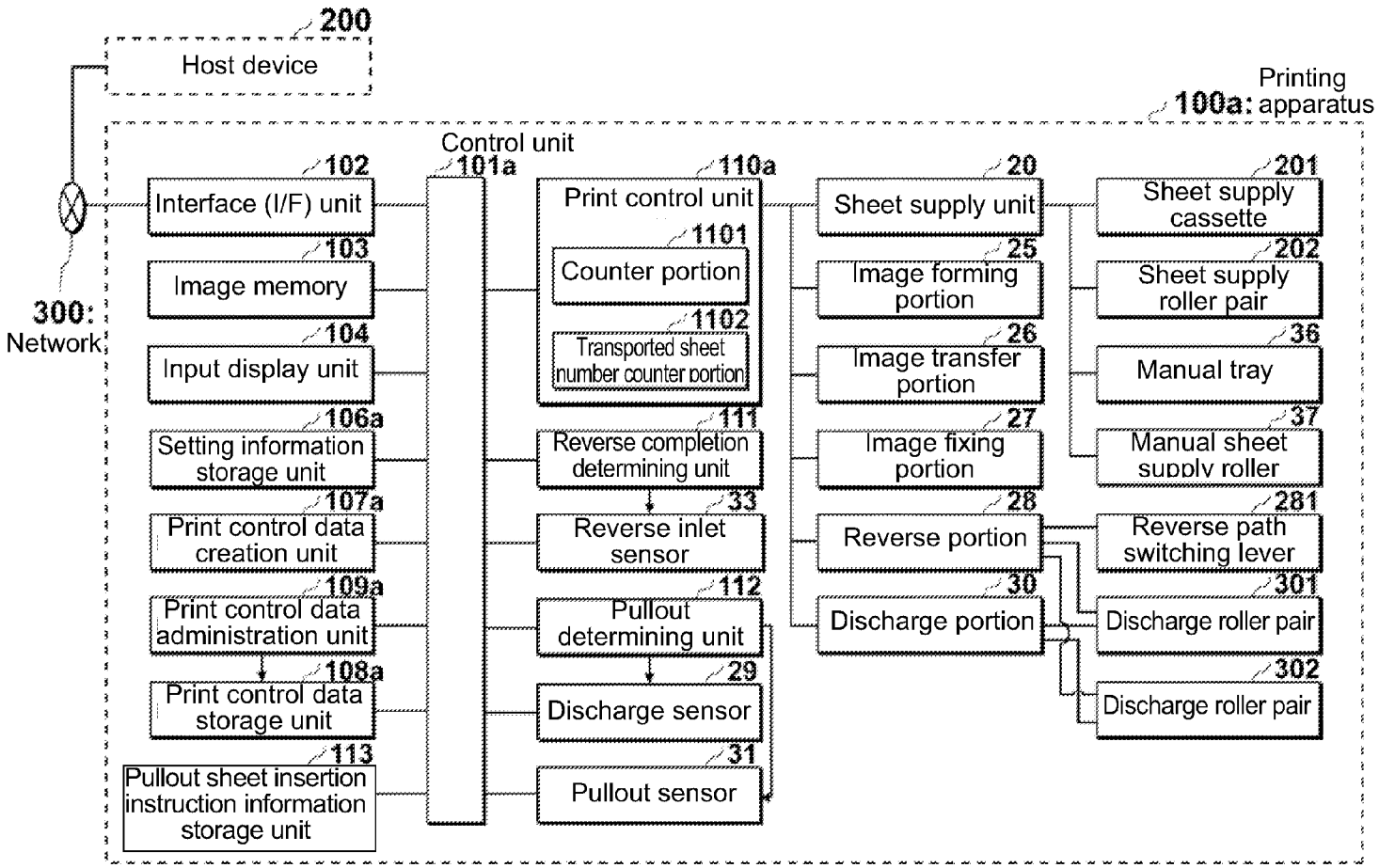
FIG. 10 is a block diagram showing a configuration of a printing apparatus according to the second embodiment of the present invention.

In the embodiment, the printing apparatus 100*a* includes a print control unit 110*a* (refer to FIG. 10). The print control unit 110*a* includes a transported sheet number counter portion 1102 (refer to FIG. 10) for counting the number of the sheets 1 transported in the printing apparatus 100*a*.

In the embodiment, the transported sheet number counter portion 1102 is configured such that a counter value thereof increases each time the sheet 1 is transported. Further, the transported sheet number counter portion 1102 is configured such that the counter value thereof decreases each time the sheet 1 is discharged from the discharge outlet 303 and placed on the discharge stacker 32, or the reverse completion determining unit 111 detects that the sheet 1 is pulled out. When the jam occurs in the printing apparatus 100*a* and is removed, the counter value is reset.

In the embodiment, the printing apparatus 100*a* includes a control unit 101*a* for sending a print instruction to the print control unit 110*a*. When the transported sheet number counter value of the transported sheet number counter portion 1102 is less than two (zero or one), the print control unit 110*a* controls the drive unit (not shown) to rotate the sheet supply roller pair 202 to pick up the sheet 1 situated at the uppermost position in the sheet supply cassette 201. After the sheet supply roller pair 202 picks up the sheet 1, the sheet 1 is transported to the transportation path A.

In the embodiment, when the sheet supply sensor 21 disposed in front of the sheet supply roller pair 202 detects the leading edge of the sheet 1, the sheet supply sensor 21 starts sending the sheet supply detection signal (sheet supply sensor ON) to the print control unit 110*a* through a control unit 101*a* (refer to FIG. 10). When the print control unit 110*a* receives the sheet supply detection signal in the duplex printing operation, the print control unit 110*a* controls the transported sheet number counter portion 1102 of the print control unit 110*a* to increase the transported sheet number counter value (the counter value is equal to one).

In the embodiment, when the inlet sensor 22 disposed in front of the register roller pair 23 detects the leading edge of the sheet 1, the inlet sensor 22 starts sending the inlet detection signal (inlet sensor ON) to the print control unit 110*a* through the control unit 101*a*. After the print control unit 110*a* receives the sheet supply detection signal when the print control unit 110*a* receives the inlet detection signal, the print control unit 110*a* drives the drive unit to rotate the register roller pair 23. Accordingly, the register roller pair 23 rotates to transport the sheet 1 toward the writing sensor 24 disposed at the rear side along the transportation path B.

In the embodiment, when the trailing edge of the sheet 1 passes through the inlet sensor 22, and the inlet sensor 22 stops sending the inlet detection signal (inlet sensor OFF), the print control unit 110*a* controls the drive unit to rotate the sheet supply roller pair 202 to transport the next sheet 1 placed in the sheet supply cassette 201 toward the transportation path A. When the sheet supply sensor 21 detects the leading edge of the next sheet 1, the sheet supply sensor 21 starts sending the sheet supply detection signal (sheet supply sensor ON) to the print control unit 110*a* through the control unit 101*a*.

In the embodiment, when the print control unit 110*a* receives the sheet supply detection signal, the print control unit 110*a* controls the transported sheet number counter portion 1102 to increase the transported sheet number counter value (the counter value is equal to two). At the same time, the print control unit 110*a* controls the drive unit to stop the sheet supply roller pair 202. Accordingly, the next sheet 1 stops in the state that the sheet supply roller pair 202 holds the next sheet 1.

In the embodiment, when the writing sensor 24 detects the leading edge of the next sheet 1 transported from the register roller pair 23, the writing sensor 24 starts sending the writing detection signal (writing sensor ON) to the print control unit 110*a* through the control unit 101*a*. When the print control unit 110*a* receives the writing signal, the print control unit 110*a* controls the drive unit to drive the image forming portion 25, the image transfer portion 26, and the image fixing portion 27, thereby performing the printing operation on the first surface of the sheet 1.

In the embodiment, after the printing operation is performed on the first surface of the sheet 1, the sheet 1 stops in the state that a part of the sheet 1 (the leading edge) is discharged from the discharge outlet 303 while the discharge roller pairs 301 and 302 sandwich the sheet 1. Further, at this moment, the pullout sensor 31 detects the sheet 1 thus stopping. Accordingly, the pullout sensor 31 continues to send the discharge outlet proximity detection signal (pullout sensor ON). Further, at this moment, the trailing edge of the sheet 1 passes through the discharge sensor 29, so that the discharge sensor 29 stops sending the discharge detection signal (discharge sensor OFF).

As shown in FIG. 3, the sheet 1 stops in the state that a part of the sheet 1 (the leading edge) is discharged from the discharge outlet 303 while the discharge roller pairs 301 and 302 sandwich the sheet 1. In this state, the operator may mistakenly recognize that the duplex printing operation is completed, and try to pull out the sheet 1 from the discharge outlet 303. If the sheet 1 is pulled out from the discharge outlet 303, the pullout sensor 31 stops sending the discharge outlet proximity detection signal (pullout sensor OFF). An operation of the printing apparatus 100*a* when the sheet 1 is pulled out will be explained later along with an explanation of a control system of the printing apparatus 100*a*.

In the embodiment, after the print control unit 110*a* stops the discharge roller pairs 301 and 302, the print control unit 110*a* controls the drive unit to rotate the discharge roller pairs 301 and 302 in the reverse direction after a specific period of time set in advance, for example, less than one second. Accordingly, the sheet 1 sandwiched with the discharge roller pairs 301 and 302 is pulled back in the printing apparatus 100*a* once again and transported along the reverse path D.

In the embodiment, when the reverse inlet sensor 33 provided along the reverse path D detects the leading edge of the sheet 1, the reverse inlet sensor 33 starts sending the reverse inlet detection signal (reverse inlet sensor ON) to the print control unit 110*a* through the control unit 101*a*. When the print control unit 110*a* receives the reverse inlet detection signal, the print control unit 110*a* controls the drive unit to rotate the reverse transportation roller pairs 282, 283, 284, and 285. At the same time, the print control unit 110*a* controls the drive unit to rotate the sheet supply roller pair 202. Accordingly, the reverse transportation roller pairs 282, 283, and 284 rotate to transport the sheet 1 toward the reverse sheet supply sensor 34 disposed at the rear side along the reverse path E. Further, the next sheet 1 sandwiched with the sheet supply roller pair 202 is transported toward the inlet sensor 22 along the transportation path A.

In the embodiment, when the reverse sheet supply sensor 34 provided along the reverse path E detects the leading edge of the sheet 1, the reverse sheet supply sensor 34 starts sending the reverse sheet supply detection signal (reverse sheet supply sensor ON) to the print control unit 110*a* through the control unit 101*a*. When the print control unit 110*a* receives the reverse sheet supply detection signal, the print control unit 110*a* controls the drive unit to stop the reverse transportation roller pairs 282, 283, 284, and 285. Accordingly, the sheet 1 stops in the state that the sheet 1 is sandwiched with the reverse transportation roller pairs 282, 283, and 284.

In the embodiment, when the inlet sensor 22 detects the leading edge of the next sheet 1 transported along the transportation path A, the inlet sensor 22 starts sending the inlet detection signal (inlet sensor ON) to the print control unit 110*a* through the control unit 101*a*. After the image forming portion 25, the image transfer portion 26, and the image fixing portion 27 operate to perform the printing operation on the first surface of the next sheet 1, a part of the next sheet 1 (the leading edge) is discharged from the discharge outlet 303, and stops in the state that the discharge roller pairs 301 and 302 stopping according to the control of the print control unit 110*a* sandwich the next sheet 1.

As described above, as shown in FIG. 3, the part of the next sheet 1 (the leading edge) is discharged from the discharge outlet 303 while the discharge roller pairs 301 and 302 sandwich the next sheet 1. In this state, the operator may mistakenly recognize that the duplex printing operation is completed, and try to pull out the next sheet 1 from the discharge outlet 303. If the next sheet 1 is pulled out from the discharge outlet 303, the pullout sensor 31 stops sending the discharge outlet proximity detection signal (pullout sensor OFF).

In this case, the operator may pull out only the next sheet 1, or pull out the next sheet 1 after pulling out the sheet 1 (consecutively pulling out two sheets). An operation of the printing apparatus 100*a* when the sheet 1 is pulled out will be explained later.

In the embodiment, after the print control unit 110*a* stops the discharge roller pairs 301 and 302, the print control unit 110*a* controls the drive unit to rotate the reverse transportation roller pairs 282, 283, 284, and 285 once again. Accordingly, the sheet 1 sandwiched with the reverse transportation roller pairs 282, 283, and 284 is transported toward the inlet sensor 22 along the reverse path F. As a result, the sheet 1 is transported in the state that the second surface faces upwardly.

In the embodiment, when the inlet sensor 22 detects the leading edge of the sheet 1, and the trailing edge of the sheet 1 passes through the inlet sensor 22 (from inlet sensor ON to inlet sensor OFF), the print control unit 110*a* controls the drive unit to rotate the discharge roller pairs 301 and 302 in the reverse direction. Accordingly, the discharge roller pairs 301 and 302 rotate to pull back the next sheet 1 sandwiched with the discharge roller pairs 301 and 302 into the printing apparatus 100*a*, and to transport the sheet 1 along the reverse path E.

In the embodiment, when the reverse sheet supply sensor 34 provided along the reverse path E detects the leading edge of the next sheet 1, the reverse sheet supply sensor 34 starts sending the reverse sheet supply detection signal (reverse sheet supply sensor ON) to the print control unit 110*a* through the control unit 101*a*. When the print control unit 110*a* receives the reverse sheet supply detection signal, the print control unit 110*a* controls the drive unit to stop the reverse transportation roller pairs 282, 283, 284, and 285. Accordingly, the next sheet 1 stops in the state that the sheet 1 is sandwiched with the reverse transportation roller pairs 282, 283, and 284.

After the image forming portion 25, the image transfer portion 26, and the image fixing portion 27 operate to perform the printing operation on the second surface of the sheet 1, the print control unit 110*a* controls the drive unit to rotate the discharge roller pairs 301 and 302 in the forward direction, so that the sheet 1 is transported toward the discharge outlet 303. When the pullout sensor 31 detects the leading edge of the sheet 1 with the both surfaces printed (pullout sensor ON), the printing apparatus 100*a* controls the drive unit to rotate the reverse transportation roller pairs 282, 283, 284, and 285 once again to transport the reversed next sheet 1.

Afterward, in the state that the second surface of the sheet 1 faces upwardly, the discharge roller pairs 301 and 302 rotate to discharge the sheet 1 from the discharge outlet 303, thereby stacking the sheet 1 on the discharge stacker 32. When the duplex printing operation is completed on the sheet 1, the print control unit 110*a* controls the transported sheet number counter portion 1102 of the print control unit 110*a* to decrease the transported sheet number counter value (the counter value is equal to one). Further, the reverse transportation roller pairs 282, 283, 284, and 285 rotate to transport the next sheet 1 toward the reverse sheet supply sensor 34 along the reverse path E.

In the embodiment, when the transported sheet number counter value of the transported sheet number counter portion 1102 becomes less than two (the counter value is equal to one), the print control unit 110*a* controls the drive unit to rotate the sheet supply roller pair 202 to transport a further next sheet 1 at the uppermost position in the sheet supply cassette 201. Accordingly, the sheet supply roller pair 202 picks up the further next sheet 1, and the further next sheet 1 is transported toward the transportation path A. Afterward, similar to the sheet 1, the print control unit 110*a* controls the printing operation on the further next sheet 1.

In the embodiment, in the state that the second surface of the next sheet 1 faces upwardly, when the inlet sensor 22 detects the leading edge of the next sheet 1, the inlet sensor 22 starts sending the inlet detection signal (inlet sensor ON) to the print control unit 110*a* through the control unit 101*a*. Afterward, when the trailing edge of the sheet 1 passes through the inlet sensor 22, the inlet sensor 22 stops sending the inlet detection signal (inlet sensor OFF). After the image forming portion 25, the image transfer portion 26, and the image fixing portion 27 operate to perform the printing operation on the second surface of the next sheet 1, the print control unit 110*a* controls the drive unit to rotate the discharge roller pairs 301 and 302 in the forward direction. Accordingly, the discharge roller pairs 301 and 302 rotate to transport the next sheet 1 toward the discharge outlet 303, so that the next sheet 1 is discharged outside the printing apparatus 100*a* through the discharge outlet 303, and is stacked on the discharge stacker 32. After the print control unit 110*a* completes the printing operation of the image data of all pages according to print control data 2 (described later), the transported sheet number counter value of the transported sheet number counter portion 1102 becomes zero.

A configuration of the control system of the printing apparatus 100*a* will be explained next. FIG. 10 is a block diagram showing the configuration of the control system of the printing apparatus 100*a* according to the second embodiment of the present invention.

As shown in FIG. 10, the control system of the printing apparatus 100*a* includes the control unit 101*a*; the interface (I/F) unit 102; the image memory 103; the input display unit 104; a setting information storage unit 106*a*; a print control data creation unit 107*a*; a print control data storage unit 108*a*; a print control data administration unit 109*a*; the print control unit 110*a*; the reverse completion determining unit 111; the pullout determining unit 112; and a pullout sheet insertion instruction information storage unit 113.

In the embodiment, when the control unit 101*a* receives print data from the host device 200 through the interface (I/F) unit 102, the control unit 101*a* controls a rasterization conversion unit (not shown) to convert the print data to image data. The print data include the printing operation instruction information indicating the single side printing operation and the duplex printing operation. The image data is provided with the printing operation instruction information included in the print data. When the control unit 101*a* stores the image data in the image memory 103, the control unit 101 instructs the print control data creation unit 107*a* to create the print control data 2.

In the embodiment, the setting information storage unit 106*a* stores various setting information to be used with the print control unit 110*a* for controlling the printing operation. More specifically, the setting information storage unit 106*a* stores the medium feed time and the reverse maximum time.

FIG. 11 is a schematic view showing a configuration of the print control data 2 and an example of a print output result according to the second embodiment of the present invention. The print control data 2 shown in FIG. 11 are an example in the case of the duplex printing operation. In the embodiment, the print control data creation unit 107*a* is provided for creating the print control data 2 to be used with the printing apparatus 100*a* for the printing operation. More specifically, when the control unit 101*a* instructs the print control data creation unit 107*a* to create the print control data 2, the print control data creation unit 107*a* creates the image data (attached with the printing operation instruction information indicating the one side printing operation or the duplex printing operation) stored in the image memory 103 and the print control data 2 having an initial printing order (a) shown in FIG. 11.

In the print control data 2 having the initial printing order (a) shown in FIG. 11, two sheets are sequentially transported. After the printing operation is performed on the first surface of each sheet, the two sheets are reversed, and the printing operation is performed on the second surface of each sheet.

As shown as a print output result (a)' in FIG. 11, when the sheet 1 is not pulled out, and the printing operation is performed according to the print control data 2 having the initial printing order (a), each odd number page of the image data is printed on the first surface of the sheet 1, and each even number page of the image data is printed on the second surface of the sheet 1.

In the embodiment, when the print control data creation unit 107*a* creates the print control data 2, the control unit 101*a* instructs the print control data administration unit 109*a* to register the print control data 2, and the control unit 101*a* sends the print control data 2 to the print control data administration unit 109*a*.

As shown in FIG. 11, the print control data storage unit 108*a* includes a printing order list storage region 1081*a* for storing a printing order list indicating the printing order of the image data; and the printing operation instruction information storage region 1082 for storing the printing operation instruction information.

In the embodiment, the print control data administration unit 109*a* is an administration unit for administrating the print control data 2 stored in the print control data storage unit 108*a*. When the print control data administration unit 109*a* receives the print control data 2 along with the instruction to register the print control data 2, the print control data administration unit 109*a* stores the print control data 2 in the print control data storage unit 108*a*.

More specifically, the print control data administration unit 109*a* stores in the printing order list storage region 1081*a* the printing order list indicating the initial printing order (a), in which the two sheets are sequentially transported. After the printing operation is performed on the first surface of each sheet, the two sheets are reversed, and the printing operation is performed on the second surface of each sheet. Further, the print control data administration unit 109 stores in the printing operation instruction information storage region 1082 the printing operation instruction information indicating the single side printing operation or the duplex printing operation as shown in FIG. 11.

In the embodiment, when the print control data administration unit 109*a* stores the print control data 2 in the print control data storage unit 108*a*, the control unit 101*a* instructs the print control unit 110*a* to perform the printing operation.

In the embodiment, the print control unit 110*a* controls the printing operation according to the print control data 2 stored in the print control data storage unit 108*a* and the image data stored in the image memory 103. In other words, the print control unit 110*a* controls each component of the printer engine.

More specifically, when the print control unit 110*a* receives the instruction of the printing operation, in the case of the duplex printing operation, the print control unit 110*a* controls the drive unit to rotate the sheet supply roller pair 202 to transport the two sheets 1 placed in the sheet supply cassette 201. Further, the print control unit 110*a* performs the printing operation on the first surface of the sheet 1 according to the printing order list stored in the printing order list storage region 1081*a*.

After the control unit 101*a* performs the printing operation on the first surface of each sheet, the print control unit 110*a* controls the drive unit to rotate the discharge roller pairs 301 and 302 in the reverse direction, so that the sheet 1 is pulled back to the printing apparatus 100*a* to be reversed. Then, the reverse completion determining unit 111 determines whether the sheet 1 is completely reversed, and sends the determination result (the reverse process is completed or the reverse process is not completed) to the control unit 101*a*.

In the embodiment, when the control unit 101*a* receives the determination result that the reverse process is completed with respect to the sheet 1 from the reverse completion determining unit 111, the control unit 101*a* sends the determination result to the print control unit 110*a*. When the print control unit 110*a* receives the determination result, the print control unit 110*a* performs the printing operation on the first surface of the next sheet 1. Then, the print control unit 110*a* controls the drive unit to rotate the discharge roller pairs 301 and 302 in the reverse direction, so that the next sheet 1 is pulled back to the printing apparatus 100*a* to be reversed.

In the embodiment, when the control unit 101*a* receives the determination result that the reverse process is not completed with respect to the sheet 1 from the reverse completion determining unit 111, the control unit 101*a* instructs the pullout determining unit 112 to determine whether the sheet 1 is pulled out. When the pullout determining unit 112 receives the instruction to determine whether the sheet 1 is pulled out, the pullout determining unit 112 sends the determination result indicating whether the sheet 1 is pulled out or the jam occurs while the sheet 1 is pulled back to the control unit 101*a*. When the control unit 101*a* receives the determination result indicating whether the sheet 1 is pulled out or the jam occurs while the sheet 1 is pulled back to the control unit 101*a*, the control unit 101*a* sends the determination result to the print control unit 110*a*.

In the embodiment, after the print control unit 110*a* receives the determination result that the reverse process is completed with respect to the sheet 1, when the print control unit 110*a* receives the determination result indicating that the reverse process is completed with respect to the next sheet 1, the print control unit 110*a* controls the drive unit to rotate the sheet supply roller pair 202 to transport the next sheet 1 from the sheet supply unit 20.

In the embodiment, after the print control unit 110*a* receives the determination result that the reverse process is completed with respect to the sheet 1, when the print control unit 110*a* receives the determination result indicating that the next sheet 1 is pulled out, it is possible to continue the printing operation with updating the print control data 2. Accordingly, the print control unit 110*a* instructs the control unit 101*a* to update the print control data 2.

In the embodiment, after the print control unit 110*a* receives the determination result that the reverse process is completed with respect to the sheet 1, when the print control unit 110*a* receives the determination result indicating that the jam occurs while the next sheet 1 is pulled back, the print control unit 110*a* stops each component of the printer engine, and displays the jam occurrence notification information stored in advance in a memory (not shown) on the display 355 of the operation panel 35. Accordingly, the operation refers to the jam occurrence notification information displayed on the display 355, and opens the cover of the printing apparatus 100*a* to remove the jam. After the operation removes the jam, the operator closes the cover.

In the embodiment, the control unit 101*a* detects whether the cover is opened or closed through a sensor (not shown). When the control unit 101*a* determines that the jam does not exist in the printing apparatus 100*a* through the ON/OFF state of various sensors, the control unit 101*a* instructs the print control unit 110*a* to resume the printing operation. When the print control unit 110*a* receives the instruction to resume the printing operation, the print control unit 110*a* initializes the transported sheet number counter value of the transported sheet number counter portion 1102, and resumes the printing operation according to the printing order list stored in the printing order list storage region 1081*a*.

In the embodiment, when the print control unit 110*a* receives the determination result indicating that the sheet 1 is pulled out, the print control unit 110*a* performs the printing operation on the first surface of the next sheet 1. Then, the print control unit 110*a* controls the drive unit to rotate the discharge roller pairs 301 and 302 in the reverse direction, so that the next sheet 1 is pulled back to the printing apparatus 100*a* to be reversed.

In the embodiment, when the print control unit 110*a* receives the determination result indicating that the jam occurs while the sheet 1 is pulled back, the print control unit 110*a* stops each component of the printer engine, and displays the jam occurrence notification information on the display 355 through the control unit 101*a*.

In the embodiment, after the print control unit 110*a* receives the determination result indicating that the sheet 1 is pulled out, the print control unit 110*a* receives the determination result that the reverse process is completed with respect to the next sheet 1, the print control unit 110*a* instructs the control unit 101*a* to update the print control data 2.

In the embodiment, after the print control unit 110*a* receives the determination result indicating that the sheet 1 is pulled out, the print control unit 110*a* receives the determination result that the next sheet 1 is pulled out, that is, the two sheets 1 are pulled out consecutively, it is not possible to update the print control data 2 and continue the printing operation. Accordingly, the print control unit 110*a* stops each component of the printer engine, and displays the jam occurrence notification information on the display 355 through the control unit 101*a*.

In the embodiment, after the print control unit 110*a* receives the determination result indicating that the sheet 1 is pulled out, the print control unit 110*a* receives the determination result that the jam occurs while the next sheet 1 is pulled back, the print control unit 110*a* stops each component of the printer engine, and displays the jam occurrence notification information on the display 355 through the control unit 101*a*.

In the embodiment, when the control unit 101*a* receives the instruction to update the print control data 2, the control unit 101*a* sends the instruction to the print control data administration unit 109*a*. When the print control data administration unit 109*a* receives the instruction to update the print control data 2, the print control data administration unit 109 updates the printing order list indicating the initial printing order (a) to the printing order list indicating a printing order (b) shown in FIG. 11.

In the printing order list indicating the printing order (b) shown in FIG. 11, when the sheet 1 is pulled out, the transported sheet number counter value of the transported sheet number counter portion 1102 decreases (the transported sheet number counter value becomes less than two). Accordingly, the sheet supply unit 20 transports the next sheet 1, and the printing operation is performed on the next sheet 1.

In the embodiment, the pullout sheet insertion instruction information storage unit 113 is provided for storing sheet insertion instruction information in advance so that the sheet 1 pulled out is inserted into the manual tray 36 when the operator pulls out the sheet 1. The sheet insertion instruction information will be explained later with reference to FIG. 12.

Figure 12:
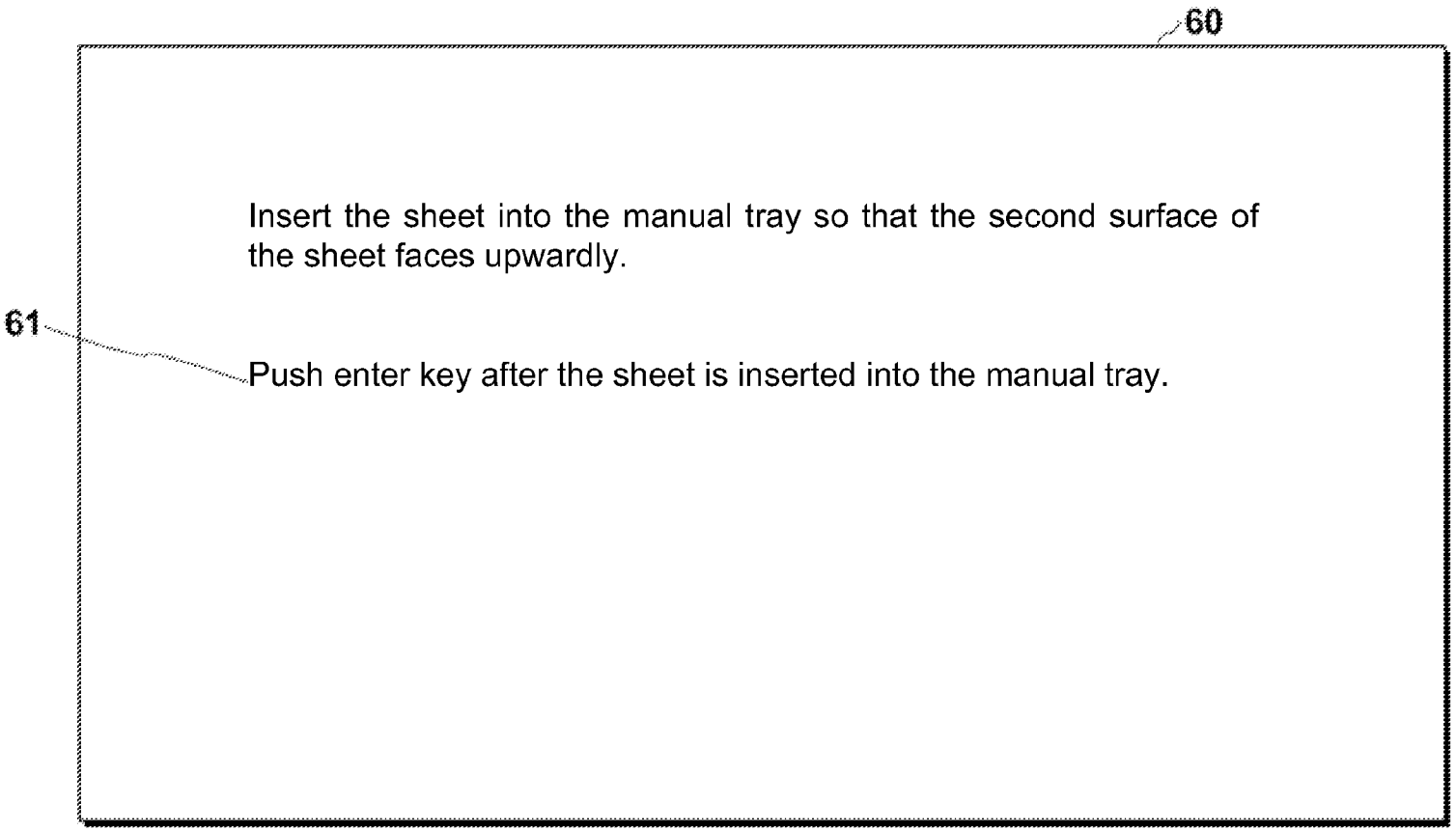
FIG. 12 is a schematic view showing an example of sheet insertion instruction information according to the second embodiment of the present invention.

In the embodiment, when the print control data administration unit 109*a* updates the print control data 2, the control unit 101*a* displays the instruction information stored in the pullout sheet insertion instruction information storage unit 113 as a form 60 shown in FIG. 12 on the display 355 of the operation panel 35. FIG. 12 is a schematic view showing an example of the sheet insertion instruction information according to the second embodiment of the present invention.

As shown in FIG. 12, the form 60 includes a message 61, so that the operator inserts the sheet 1 into the manual tray 36 such that the second surface of the sheet 1 faces upwardly when the operator pulls out the sheet 1. Then, the operator is prompted to push the enter key 352. As described above, the manual tray 36 is provided separately from the sheet supply cassette 201 for inserting the sheet 1 pulled out into the printing apparatus 100*a*.

In the embodiment, when the operator inserts the sheet 1 into the manual tray 36 such that the second surface of the sheet 1 faces upwardly with reference to the form 60 displayed on the display 355, and pushes the enter key 352 of the operation panel 35, the control unit 101*a* instructs the print control unit 110*a* to transport the sheet 1 through the manual tray 36. An insertion detection unit is provided for detecting that the sheet 1 is inserted into the manual tray 36 when the operator pushes the enter key 352 of the operation panel 35.

In the embodiment, when the print control unit 110*a* receives the instruction to transport the sheet 1 through the manual tray 36, the print control unit 110*a* controls the drive unit to rotate the manual sheet supply roller 37. Accordingly, the manual sheet supply roller 37 rotates to transport the sheet 1 toward the register roller pair 23 such that the second surface of the sheet 1 faces upwardly. When the inlet sensor 22 disposed in front of the register roller pair 23 detects the leading edge of the sheet 1 transported from the manual tray 36 such that the second surface of the sheet 1 faces upwardly, the inlet sensor 22 starts sending the inlet detection signal (inlet sensor ON) to the print control unit 110*a* through the control unit 101*a*.

In the embodiment, the print control unit 110*a* performs the printing operation on the second surface of the sheet 1 inserted through the manual tray 36 according to the print control data 2 updated and stored in the print control data storage unit 108*a*, and discharges the sheet 1 to the discharge stacker 32. Accordingly, the image data to be printed on the second surface of the sheet 1 are printed as the operator desires as a print result (b)' shown in FIG. 11. After the print control unit 110*a* performs the duplex printing operation on the next sheet 1, the print control unit 110*a* continues the printing operation according to the printing order list until the image data of all pages are printed.

Figure 13:
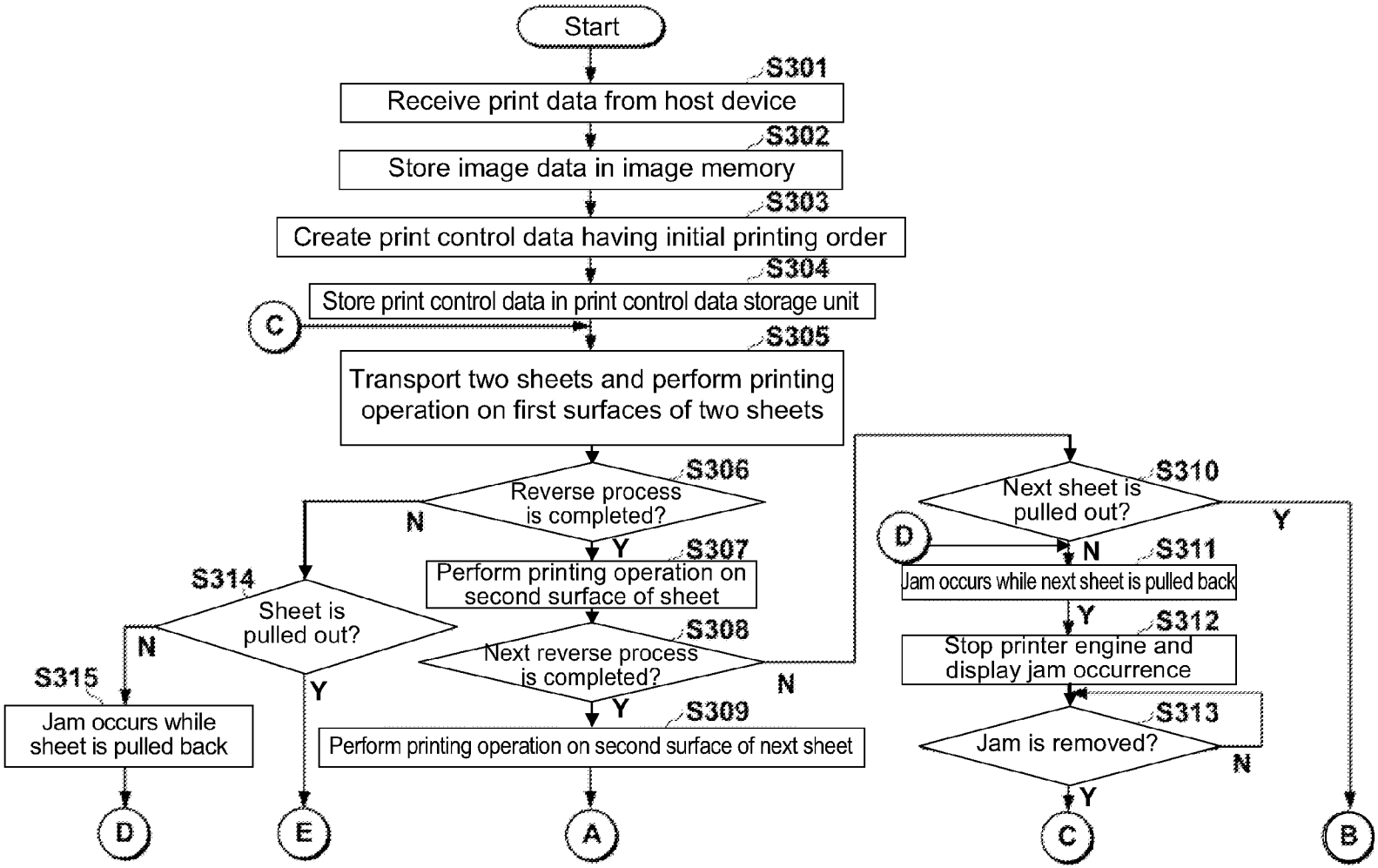
FIG. 13 is a flow chart No. 1 showing a duplex printing operation of the printing apparatus according to the second embodiment of the present invention.
Figure 14:
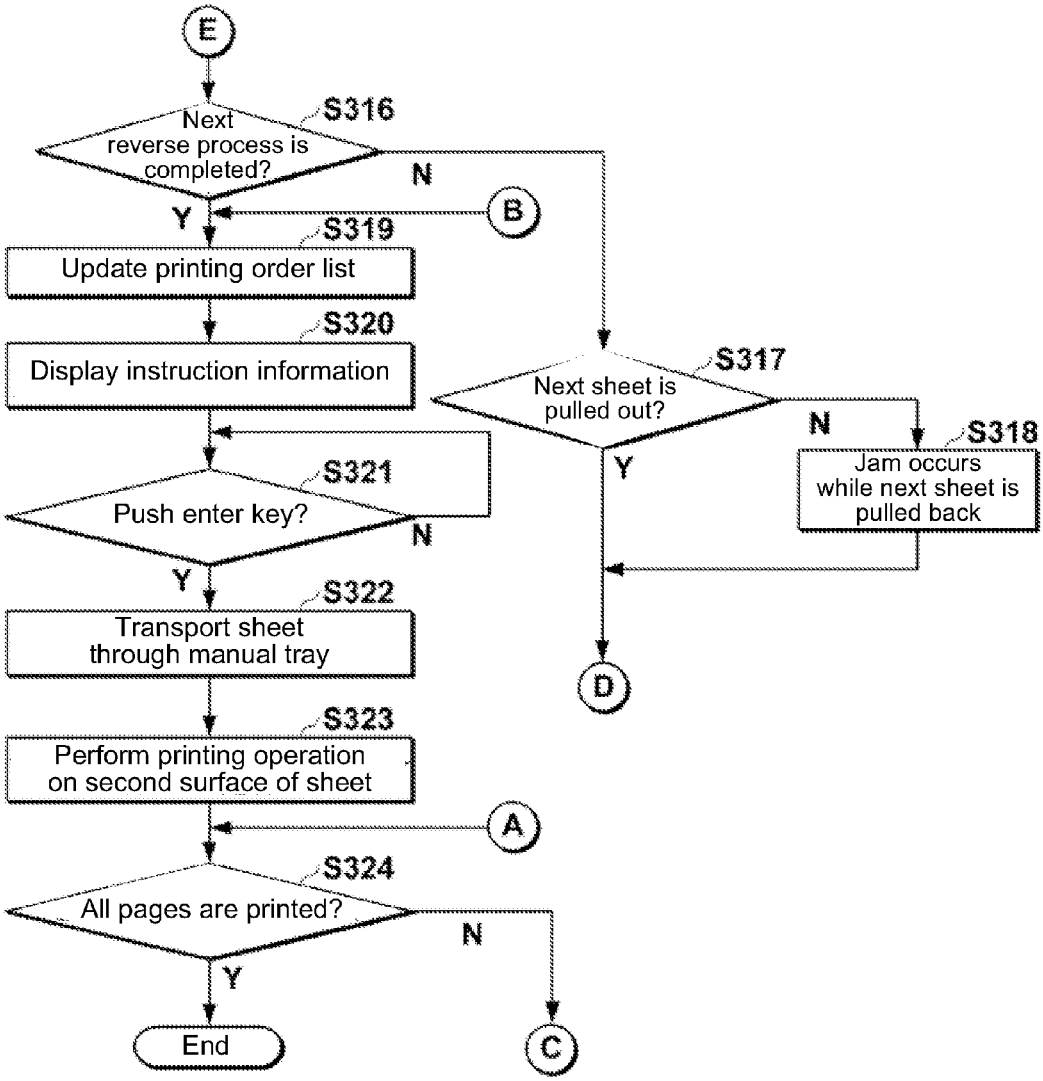
FIG. 14 is a flow chart No. 2 showing the duplex printing operation of the printing apparatus according to the second embodiment of the present invention.

The duplex printing operation of the printing apparatus 100 will be explained next with reference to flow charts shown in FIGS. 13 and 14. FIG. 13 is a flow chart No. 1 showing the duplex printing operation of the printing apparatus 100*a* according to the second embodiment of the present invention. FIG. 14 is a flow chart No. 2 showing the duplex printing operation of the printing apparatus 100*a* according to the second embodiment of the present invention.

In step S301, when the control unit 101*a* of the printing apparatus 100*a* receives the print data from the host device 200 through the interface (I/F) unit 102, the control unit 101*a* controls the rasterization conversion unit (not shown) to convert the print data to the image data. In step S302, when the control unit 101*a* stores the image data in the image memory 103, the control unit 101*a* instructs the print control data creation unit 107*a* to create the print control data 2.

In step S303, when the control unit 101*a* instructs the print control data creation unit 107*a* to create the print control data, the print control data creation unit 107*a* creates the print control data having the initial printing order (a) shown in FIG. 6 according to the image data of six pages (attached with the printing operation instruction information indicating the duplex printing operation) stored in the image memory 103 and the after pullout printing order information stored in the setting information storage unit 106 indicating one of "the single side printing operation on one sheet, the duplex printing operation on subsequent sheets" and "the duplex printing operation on subsequent sheets".

In the print control data having the initial printing order (a), the two sheets 1 are sequentially transported. After the image data of 1 page and 3 page are sequentially printed on the first surfaces of the two sheets 1, the two sheets 1 are reversed, and the image data of 2 page and 4 page are sequentially printed on the second surfaces of the two sheets 1. Then, the image data of 5 page are printed on the first surface of a third sheet, and the third sheet is reversed. Then, the image data of 6 page are printed on the second surface of the third sheet In the next step, when the print control data creation unit 107*a* creates the print control data 2, the control unit 101*a* instructs the print control data administration unit 109*a* to register the print control data 2, and the control unit 101*a* sends the print control data 2 to the print control data administration unit 109*a*.

In step S304, when the print control data administration unit 109*a* receives the print control data 2 along with the instruction to register the print control data 2, the print control data administration unit 109*a* stores the print control data 2 in the print control data storage unit 108*a*.

More specifically, the print control data administration unit 109*a* stores the printing order list indicating the initial printing order (a) shown in FIG. 11 in the printing order list storage region 1081*a*. Further, the print control data administration unit 109*a* stores the printing operation instruction information indicating the duplex printing operation in the printing operation instruction information storage region 1082.

In the next step, when the print control data administration unit 109*a* stores the print control data 2 in the print control data storage unit 108*a*, the control unit 101*a* instructs the print control unit 110*a* to perform the printing operation.

In step S305, when the print control unit 110*a* receives the instruction of the printing operation, the print control unit 110*a* controls the drive unit to rotate the sheet supply roller pair 202 to transport the two sheets 1 placed at the uppermost position in the sheet supply cassette 201 according to the printing order list stored in the printing order list storage region 1081, thereby performing the printing operation on the first surfaces of the two sheets 1.

After the control unit 101*a* performs the printing operation on the first surface of the sheet 1, the print control unit 110*a* controls the drive unit to rotate the discharge roller pairs 301 and 302 in the reverse direction, so that the sheet 1 is pulled back to the printing apparatus 100*a* to be reversed. Then, the reverse completion determining unit 111 determines whether the sheet 1 is completely reversed, and sends the determination result (the reverse process is completed or the reverse process is not completed) to the control unit 101*a*.

In step S306, when the control unit 101*a* receives the determination result that the reverse process is completed with respect to the sheet 1 from the reverse completion determining unit 111, the control unit 101*a* sends the determination result to the print control unit 110*a*. In step S307, when the print control unit 110*a* receives the determination result, the print control unit 110*a* performs the printing operation on the second surface of the sheet 1. Then, the print control unit 110*a* controls the drive unit to rotate the discharge roller pairs 301 and 302 in the reverse direction, so that the next sheet 1 is pulled back to the printing apparatus 100*a* to be reversed.

When the reverse completion determining unit 111 receives the determination result that the reverse process is not completed with respect to the sheet 1, the control unit 101*a* instructs the pullout determining unit 112 to determine whether the sheet 1 is pulled out. When the pullout determining unit 112 receives the instruction to determine whether the sheet 1 is pulled out, the pullout determining unit 112 sends the determination result indicating that the jam occurs while the sheet 1 is pulled back or the sheet 1 is pulled out to the control unit 101*a*.

When the control unit 101*a* receives the determination result indicating that the jam occurs while the sheet 1 is pulled back or the sheet 1 is pulled out to the print control unit 110*a*.

In step S308, after the control unit 101*a* receives the determination result that the reverse process is completed with respect to the sheet 1, when the control unit 101*a* receives the determination result that the reverse process is completed with respect to the next sheet 1, the control unit 101*a* sends the determination result to the print control unit 110*a*. In step S309, when the print control unit 110*a* receives the determination result, the print control unit 110*a* performs the printing operation on the second surface of the next sheet 1. Then, the printing operation is performed on the further next sheet 1.

In step S310, after the print control unit 110*a* receives the determination result that the reverse process is completed with respect to the sheet 1, the control unit 101*a* receives the determination result that the next sheet 1 is pulled out. When the print control unit 110*a* receives the determination result indicating that the next sheet 1 (total one sheet) is pulled out, it is possible to continue the printing operation with updating the print control data 2. Accordingly, the print control unit 110*a* instructs the control unit 101*a* to update the print control data 2.

In step S311, after the print control unit 110*a* receives the determination result that the reverse process is completed with respect to the sheet 1, the control unit 101*a* receives the determination result that the jam occurs while the next sheet 1 is pulled back. In step S312, the print control unit 110*a* stops each component of the printer engine, and displays the jam occurrence notification information on the display 355 of the operation panel 35.

In step S313, when the control unit 101*a* determines that the jam is removed by the operator, the control unit 101*a* instructs the print control unit 110*a* to resume the printing operation. When the print control unit 110*a* receives the instruction to resume the printing operation, the print control unit 110*a* initializes the transported sheet number counter value of the transported sheet number counter portion 1102, and resumes the duplex printing operation according to the printing order list stored in the printing order list storage region 1081*a*.

In step S314, when the print control unit 110*a* receives the determination result that the sheet 1 is pulled out, the print control unit 110*a* performs the printing operation on the first surface of the next sheet 1. Then, the print control unit 110*a* controls the drive unit to rotate the discharge roller pairs 301 and 302 in the reverse direction, so that the next sheet 1 is pulled back to the printing apparatus 100*a* to be reversed.

In step S315, when the print control unit 110*a* receives the determination result that the jam occurs while the sheet 1 is pulled back, the print control unit 110*a* stops each component of the printer engine, and displays the jam occurrence notification information on the display 355 of the operation panel 35 through the control unit 101*a*.

In step S316, after the print control unit 110*a* receives the determination result that the sheet 1 is pulled out, the print control unit 110*a* receives the determination result indicating that the reverse process is completed with respect to the next sheet 1. In this case, the sheet 1 (total one sheet) is pulled out, so that it is possible to continue the printing operation with updating the print control data 2. Accordingly, the print control unit 110*a* instructs the control unit 101*a* to update the print control data 2.

In step S317, after the print control unit 110*a* receives the determination result that the sheet 1 is pulled out, the print control unit 110*a* receives the determination result indicating that the next sheet 1 is pulled out. In this case, total two sheets are pulled out, so that it is not possible to continue the printing operation with updating the print control data 2. Accordingly, the print control unit 110*a* stops each component of the printer engine, and displays the jam occurrence notification information on the display 355 of the operation panel 35.

In step S318, after the print control unit 110*a* receives the determination result that the sheet 1 is pulled out, the print control unit 110*a* receives the determination result indicating that the jam occurs while the next sheet 1 is pulled back. In this case, the print control unit 110*a* stops each component of the printer engine, and displays the jam occurrence notification information on the display 355 of the operation panel 35.

In step S319, when the control unit 101*a* receives the instruction to update the print control data 2, the control unit 101*a* sends the instruction to the print control data administration unit 109*a*. When the print control data administration unit 109*a* receives the instruction to update the print control data 2, the print control data administration unit 109 updates the printing order list indicating the initial printing order (a) to the printing order list indicating a printing order (b) shown in FIG. 11.

In the printing order list indicating the printing order (b) shown in FIG. 11, when the sheet 1 is pulled out, the transported sheet number counter value of the transported sheet number counter portion 1102 decreases (the transported sheet number counter value becomes less than two). Accordingly, the sheet supply unit 20 transports the further next sheet 1, and the printing operation is performed on the further next sheet 1.

In step S320, when the print control data administration unit 109*a* updates the print control data 2, the control unit 101*a* displays the instruction information stored in the pullout sheet insertion instruction information storage unit 113 as the form 60 shown in FIG. 12 on the display 355 of the operation panel 35.

In S321, when the operator inserts the sheet 1 into the manual tray 36 such that the second surface of the sheet 1 faces upwardly with reference to the form 60 displayed on the display 355, and pushes the enter key 352 of the operation panel 35, the control unit 101*a* instructs the print control unit 110*a* to transport the sheet 1 through the manual tray 36.

In step S322, when the print control unit 110*a* receives the instruction to transport the sheet 1 through the manual tray 36, the print control unit 110*a* controls the drive unit to rotate the manual sheet supply roller 37. Accordingly, the manual sheet supply roller 37 rotates to transport the sheet 1 toward the register roller pair 23 such that the second surface of the sheet 1 faces upwardly. When the inlet sensor 22 disposed in front of the register roller pair 23 detects the leading edge of the sheet 1 transported from the manual tray 36 such that the second surface of the sheet 1 faces upwardly, the inlet sensor 22 starts sending the inlet detection signal (inlet sensor ON) to the print control unit 110*a* through the control unit 101*a*.

In step S323, the print control unit 110*a* performs the printing operation on the second surface of the sheet 1 inserted through the manual tray 36 according to the print control data 2 updated and stored in the print control data storage unit 108*a*, and discharges the sheet 1 to the discharge stacker 32. Accordingly, the image data to be printed on the second surface of the sheet 1 are printed as the operator desires as a print result (b)' shown in FIG. 11.

In step S324, after the print control unit 110*a* performs the duplex printing operation on the next sheet 1, the print control unit 110*a* continues the printing operation according to the printing order list until the image data of all pages are printed.

As described above, in the second embodiment, in the duplex printing operation of the printing apparatus 100*a*, when the sheet 1 is pulled out, the operator inserts the sheet 1 thus pulled out into the manual tray 36 such that the second surface of the sheet 1 faces upwardly. Accordingly, the image data to be printed are printed on the second surface of the sheet 1, thereby making it possible to obtain the desired print out result.

In the printing apparatus 100 in the first embodiment, the operator operates the input display unit 104 to set the after pullout printing order indicating one of "the single side printing operation on one sheet, the duplex printing operation on subsequent sheets", "the duplex printing operation on subsequent sheets" or "the single side printing operation on subsequent sheets" in the after pullout printing order storage region 1083 of the print control data storage unit 108.

Alternatively, similar to the printing apparatus 100*a* in the second embodiment, the operator may operate the input display unit 104 to set the after pullout printing order indicating "the single side printing operation on a sheet inserted through the manual tray, the duplex printing operation on subsequent sheets" in the after pullout printing order storage region 1083 of the print control data storage unit 108. In this case, the operator inserts the sheet 1 thus pulled out into the manual tray 36 such that the second surface of the sheet 1 faces upwardly. After the printing operation is performed on the second surface of the sheet 1, the duplex printing operation is performed on subsequent sheets.

In the printing apparatus 100*a* in the second embodiment, when the sheet 1 is pulled out, the operator inserts the sheet 1 thus pulled out into the manual tray 36 such that the second surface of the sheet 1 faces upwardly. Accordingly, the image data to be printed are printed on the second surface of the sheet 1, and the duplex printing operation is performed on subsequent sheets. Alternatively, similar to the printing apparatus 100 in the first embodiment, the operator may operate the input display unit 104 to set the after pullout printing order. In this case, the print control data storage unit 108*a* of the printing apparatus 100*a* includes a printing order storage region for storing the after pullout printing order information.

When the printing apparatus 100*a* has the configuration described above, the operator may operate the input display unit 104 to set the after pullout printing order indicating one of "the single side printing operation on one sheet, the duplex printing operation on subsequent sheets", "the duplex printing operation on subsequent sheets", and "the single side printing operation on a sheet inserted through the manual tray, the duplex printing operation on subsequent sheets". The after pullout printing order is stored in the printing order storage region of the print control data storage unit 108*a*. When the sheet 1 is pulled out, the printing apparatus 100*a* performs the printing operation according to the after pullout printing order.

In the first embodiment, the printing apparatus 100 includes a setting unit formed of the input display unit 104 and the after pullout printing order storage region 1083 of the print control data storage unit 108. With the setting unit, when the pullout determining unit 112 detects that the sheet 1 is pulled out, the print control unit 110 is set to transport the sheet 1 supplied from the sheet supply unit 20 to the image forming portion or supplied from the manual tray 36 (the sheet 1 pulled out) toward the image forming portion (the image forming portion 25, the image transfer portion 26, and the image fixing portion 27). Similarly, in the second embodiment, the printing apparatus 100*a* includes a setting unit formed of the input display unit 104 and the after pullout printing order storage region of the print control data storage unit 108*a*.

In the first embodiment and the second embodiment, the printing apparatus 100 and the printing apparatus 100*a* are explained as a printer. Alternatively, the present invention is not limited to the printer, and may be applicable to a multi function product (MFP) having a printer function and the like.

The disclosure of Japanese Patent Application No. 2009-081384, filed on Mar. 30, 2009, is incorporated in the application by the reference.

While the invention has been explained with reference to the specific embodiments of the invention, the explanation is illustrative and the invention is limited only by the appended claims.

What is claimed is:

1. A printing apparatus for performing a printing operation, comprising:

an image forming portion for forming a first image on a first surface of a first sheet according to first image data;

a discharge portion for discharging the first sheet;

a reverse transportation unit for returning the first sheet into the printing apparatus to reverse the first sheet so that the image forming portion forms a second image on a second surface of the first sheet according to second image data;

a detection unit for detecting whether the first sheet is pulled out before the reverse transportation unit returns the first sheet;

a sheet supply unit for transporting the first sheet to the image forming portion; and a control unit for controlling the image forming portion to form the second image on a second sheet according to the second image data when the detection unit detects that the first sheet is pulled out, wherein said control unit is configured to be capable of selecting one of a first printing process and a second printing process to be performed after the detection unit detects that the first sheet is pulled out in a duplex printing operation, in the first printing process, said control unit is configured to control the sheet supply unit to transport the second sheet and to control the image forming portion to form the second image on one side of the second sheet when the detection unit detects that the first sheet is pulled out, in the second printing process, said control unit is configured to control the sheet supply unit to transport the second sheet and to control the image forming portion to form the second image and a third image on two sides of the second sheet in the duplex printing operation when the detection unit detects that the first sheet is pulled out, and said control unit is configured to control the image forming portion to perform the one of the first printing process and the second printing process when the detection unit detects that the first sheet is pulled out in the duplex printing operation.

2. The printing apparatus according to claim 1, wherein said reverse transportation unit is arranged to return the first sheet when the discharge portion discharges a part of the first sheet.

3. The printing apparatus according to claim 1, further comprising a sheet supply unit for transporting the first sheet to the image forming portion, said control unit controlling the sheet supply unit to transport the second sheet and controlling the image forming portion to form the second image on the second sheet when the detection unit detects that the first sheet is pulled out.

4. The printing apparatus according to claim 1, wherein said control unit is further configured to be capable of selecting a third printing process in which said control unit controls the sheet supply unit to transport the second sheet and controls the image forming portion to form the second image on one side of the second sheet and form the third image on one side of a third sheet and form subsequent images including the fourth image and the fifth image separately on one side of subsequent sheets in a single side printing operation when the detection unit detects that the first sheet is pulled out, and in the first printing process, said control unit is configured to control the sheet supply unit to transport the third sheet and to control the image forming portion to form the third image and the fourth image on two sides of the third sheet when the detection unit detects that the first sheet is pulled out.

5. The printing apparatus according to claim 1, further comprising an manual insertion unit for inserting the first sheet, an insertion detection unit for detecting that the first sheet is inserted into the manual insertion unit, and a manual sheet supply unit for transporting the first sheet when the insertion detection unit detects that the first sheet is inserted into the manual insertion unit, said control unit controlling the image forming portion to form the second image on the second surface when the detection unit detects that the first sheet is pulled out and the insertion detection unit detects that the first sheet is inserted into the manual insertion unit.

6. The printing apparatus according to claim 5, further comprising a display control unit for displaying notification information on a display unit to prompt the first sheet to be inserted into the manual insertion unit such that the second surface faces upwardly when the detection unit detects that the first sheet is pulled out.

7. The printing apparatus according to claim 5, further comprising an operation unit having a return key, said insertion detection unit detecting that the first sheet is inserted into the manual insertion unit when the return key is pushed.

8. The printing apparatus according to claim 5, further comprising a setting unit for setting one of a first printing order and a second printing order when the detection unit detects that the first sheet is pulled out, said control unit controlling a sheet supply unit to transport the second sheet so that the image forming unit forms the second image on the second sheet in the first printing order, said control unit controlling the image forming portion to form the second image on the second surface when the detection unit detects that the first sheet is pulled out and the insertion detection unit detects that the first sheet is inserted into the manual insertion unit in the second printing order.

9. The printing apparatus according to claim 6, wherein said control unit is arranged to control the image forming unit to form the second image on the second sheet when the detection unit detects that the first sheet is pulled out and a sheet supply unit completely transports the second sheet, said display control unit displaying the notification information on the display unit after the reverse transportation unit reverses the second sheet.

10. The printing apparatus according to claim 1, wherein said detection unit includes a first sensor disposed near the discharge portion for detecting the first sheet discharged from the discharge portion and the first sheet returned into the printing apparatus with the reverse transportation unit, and a second sensor for detecting the first sheet in the reverse transportation unit.

11. The printing apparatus according to claim 10, wherein said detection unit is arranged to detect that the first sheet is pulled out when the first sensor and the second sensor do not detect the first sheet after a specific period of time after the reverse transportation unit operates to return the first sheet into the printing apparatus.

12. The printing apparatus according to claim 1, wherein, in the first printing process, said control unit is configured to control the sheet supply unit to transport the second sheet and to control the image forming portion to form subsequent images including the third image and a fourth image on two sides of subsequent sheets in the duplex printing operation when the detection unit detects that the first sheet is pulled out, and in the second printing process, said control unit is configured to control the sheet supply unit to transport the second sheet and to control the image forming portion to form subsequent images including a fourth image and a fifth image on subsequent sheets in the duplex printing operation when the detection unit detects that the first sheet is pulled out.

13. A printing apparatus for performing a printing operation, comprising:

an image forming portion for forming a first image on a first surface of a first sheet according to first image data;

a discharge portion for discharging the first sheet;

a reverse transportation unit for returning the first sheet into the printing apparatus to reverse the first sheet so that the image forming portion forms a second image on a second surface of the first sheet according to second image data;

a detection unit for detecting whether the first sheet is pulled out before the reverse transportation unit returns the first sheet;

a sheet supply unit for transporting the first sheet to the image forming portion;

a control unit for controlling the image forming portion to form the second image on a second sheet according to the second image data when the detection unit detects that the first sheet is pulled out, wherein said control unit is configured to be capable of selecting one of a first printing process and a second printing process to be performed after the detection unit detects that the first sheet is pulled out in a duplex printing operation, in the first printing process, said control unit is configured to control the sheet supply unit to transport the second sheet and to control the image forming portion to form the second image on one side of the second sheet when the detection unit detects that the first sheet is pulled out, in the second printing process, said control unit is configured to control the sheet supply unit to transport the second sheet and to control the image forming portion to form the second image on one side of the second sheet and form subsequent images including a third image and a fourth image on one sides of subsequent sheets in a single side printing operation when the detection unit detects that the first sheet is pulled out in the duplex printing operation, and said control unit is configured to control the image forming portion to perform the one of the first printing process and the second printing process when the detection unit detects that the first sheet is pulled out in the duplex printing operation.

14. The printing apparatus according to claim 13, wherein, in the first printing process, said control unit is configured to control the sheet supply unit to transport the second sheet and to control the image forming portion to form subsequent images including the third image and the fourth image on two sides of subsequent sheets in the duplex printing operation when the detection unit detects that the first sheet is pulled out.

* * * * *